US006187181B1

(12) United States Patent
Stoltz et al.

(10) Patent No.: US 6,187,181 B1
(45) Date of Patent: Feb. 13, 2001

(54) FLOATING SKIMMER

(75) Inventors: Gerhardus J. Stoltz; Christopher E. Hatch, both of San Diego; Mark D. Van Etten, Temecula, all of CA (US)

(73) Assignee: Polaris Pool Systems, Inc., Vista, CA (US)

( * ) Notice: Under 35 U.S.C. 154(b), the term of this patent shall be extended for 0 days.

(21) Appl. No.: 09/431,667

(22) Filed: Nov. 1, 1999

(51) Int. Cl.[7] ..... E04H 4/16

(52) U.S. Cl. ..... 210/122; 210/123; 210/169; 210/242.1; 15/1.7; 4/490

(58) Field of Search ..... 210/122, 123, 210/169, 242.1, 416.2; 15/1.7; 4/490

(56) References Cited

U.S. PATENT DOCUMENTS

| | | | | |
|---|---|---|---|---|
| 3,212,268 | * | 10/1965 | Ortcyn | 210/169 |
| 3,252,576 | * | 5/1966 | Muller | 210/169 |
| 3,616,916 | * | 11/1971 | Greene | 210/169 |
| 3,620,372 | * | 11/1971 | Ehret | 210/169 |
| 3,688,909 | | 9/1972 | Titus et al. | 210/242.3 |
| 3,706,379 | * | 12/1972 | Erlich | 210/169 |
| 3,841,487 | * | 10/1974 | Villette | 210/123 |
| 3,928,202 | | 12/1975 | Raubenheimer | 15/1.7 |
| 3,970,556 | | 7/1976 | Gore | 210/242.3 |
| 4,105,557 | | 8/1978 | Weatherholt | 210/169 |
| 4,348,281 | * | 9/1982 | Perry et al. | 210/169 |
| 4,737,279 | * | 4/1988 | Lewis | 210/416.2 |
| 4,740,357 | * | 4/1988 | Buelteman | 210/169 |
| 4,743,368 | * | 5/1988 | Gates | 210/169 |
| 4,746,424 | | 5/1988 | Drew | 210/242.1 |
| 4,776,953 | * | 10/1988 | Frentzel | 210/169 |
| 4,802,592 | | 2/1989 | Wessels | 210/242.1 |
| 4,889,622 | | 12/1989 | Newcombe-Bond | 210/242.1 |
| 5,078,863 | * | 1/1992 | Durigon | 210/123 |
| 5,133,854 | | 7/1992 | Horvath | 210/169 |
| 5,143,605 | | 9/1992 | Masciarelli | 210/169 |
| 5,498,348 | | 3/1996 | Plink et al. | 210/122 |
| 5,605,622 | * | 2/1997 | Farraro | 210/169 |

* cited by examiner

*Primary Examiner*—Christopher Upton
(74) *Attorney, Agent, or Firm*—Kelly Bauersfeld Lowry & Kelley, LLP

(57) ABSTRACT

A floating skimmer is provided for use with a pool cleaner of the type powered by a suction or vacuum source, such as by connecting the pool cleaner via a vacuum hose or the like to the suction side of conventional pool water filtration equipment, wherein the floating skimmer is coupled along the vacuum hose and functions to collect debris picked up by the pool cleaner as well as floating debris such as leaves and the like on the pool water surface. The floating skimmer comprises a buoyant housing having a perforated collection basket therein defining a primary debris collection chamber adapted for in-line connection along the vacuum hose to capture debris entrained with water drawn from the suction-powered pool cleaner to the filtration system. The perforated basket additionally defines a secondary debris collection chamber for capturing floating surface debris drawn over at least one weir, with a flow control valve assembly regulating the weir surface flow to insure that a sufficient flow is drawn through the pool cleaner for proper pool cleaner operation. A water level regulator float responds to the water level within the skimmer housing to variably open and close submerged auxiliary intake ports therein to maintain the water level generally between predetermined maximum and minimum limits. The collection basket is mounted within the buoyant housing for quick and easy removal as needed to dispose of collected debris.

47 Claims, 24 Drawing Sheets

FLOATING SKIMMER

BACKGROUND OF THE INVENTION

This invention relates generally to pool cleaning systems of the type including a so-called automatic pool cleaning device adapted for travel over submerged surfaces of a swimming pool or the like to pick up and collect accumulated debris such as leaves, twigs, sand and silt. More particularly, this invention relates to a floating skimmer for use in combination with a pool cleaner of the so-called suction or vacuum powered type, wherein the floating skimmer is designed for capturing large or sizable debris picked up by the pool cleaner while additionally collecting debris such as leaves and twigs and the like floating on the surface of the pool water.

Pool cleaner systems and related devices are generally well known in the art for use in maintaining residential and commercial swimming pools in a clean and attractive condition. In this regard, swimming pools conventionally include a water filtration system equipped with a pump for drawing or suctioning water from the pool for circulation through a filter canister having filter media therein to remove and collect water-entrained debris such as leaves and twigs as well as fine particulate including sand and silt. In a typical arrangement, at least a portion of the pool water is vacuum-drawn over a weir mounted within a so-called skimmer well positioned substantially at the water surface to draw and collect floating debris to the filter equipment. The filter canister captures and retains water-entrained debris, and the water is recirculated to the pool via one or more return lines. Such filtration equipment is normally operated for several hours on a daily basis and serves, in combination with traditional chemical treatments such as chlorination or the like, to maintain the pool water in a clean and clear sanitary state. However, the water filtration system is ineffective to filter out debris which settles onto submerged floor and side wall surfaces of the swimming pool. In the past, settled debris has typically been removed by coupling a vacuum hose to the suction side of the pool water filtration system, such as by connecting the vacuum hose to the skimmer well located near the water surface at one side of the pool, and then manually moving a vacuum head coupled to the hose over the submerged pool surfaces to vacuum settled debris directly to the filter canister where it is collected and separated from the pool water. However, manual vacuuming of a swimming pool is a time consuming and labor intensive task and is thus not typically performed by the pool owner or pool cleaning service personnel on a daily basis.

So-called automatic pool cleaner devices have been developed over the years for cleaning submerged pool surfaces, thereby substantially eliminating the need for labor intensive manual vacuuming. Such automatic pool cleaners typically comprise a relatively compact cleaner housing or head coupled to the pool water filtration system by a hose and including water-powered means for causing the cleaner to travel about within a swimming pool to dislodge and collect settled debris. In one form, the pool cleaner is connected to the return or pressure side of the filtration system for receiving positive pressure water which powers a turbine for rotatably driving cleaner wheels, and also functions by venturi action to draw settled debris into a filter bag. See, for example, U.S. Pat. Nos. 3,882,574; 4,558,479; 4,589,986; and 4,734,954. In another form, the pool cleaner is coupled by a vacuum hose to the suction side of the filtration system, whereby water is drawn under negative pressure through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,643,217; 4,679,867; 4,729,406; 4,761,848; 5,105,496; 5,265,297; and 5,634,229. See also copending U.S. Ser. No. 09/090,894, filed Jun. 4, 1998.

While both positive pressure and suction side pool cleaners have proven to be generally effective in cleaning settled debris and the like from submerged pool surfaces, various customer preferences and installation considerations have been instrumental in causing an individual customer to choose one cleaner type over the other. In this regard, positive pressure cleaners often require modifications to the filtration system in an existing pool, such as a booster pump and/or an additional water return line. By comparison, suction side cleaners are often installed without requiring any modifications to the existing pool filtration equipment by coupling the vacuum hose directly into the existing pool skimmer well. For this reason, suction side cleaners are preferred by some customers. However, connection of the vacuum hose into the pool skimmer well effectively disables the skimming function, such that floating debris is not cleaned from the pool surface.

The present invention relates to a floating skimmer designed for in-line connection along the vacuum hose coupled between a suction-powered pool cleaner and the suction side of the pool filtration system, such as by connection to the skimmer well, wherein the floating skimmer effectively skims and collects floating debris from the surface of the pool water while additionally trapping and collecting large debris picked up by the pool cleaner.

SUMMARY OF THE INVENTION

In accordance with the invention, a floating skimmer is provided for use with a pool cleaner of the type powered by a suction or vacuum source, wherein the floating skimmer functions to collect debris picked up by the pool cleaner as well as floating debris such as leaves and the like on the pool water surface. The floating skimmer comprises a buoyant housing having a perforated collection basket therein defining a primary debris collection chamber adapted for in-line connection along the length of a vacuum hose coupled between the suction-powered pool cleaner and the suction side of a pool filtration system, so that water drawn from the pool cleaner to the filtration system flows through the primary collection chamber for capture of water-entrained debris therein. The collection basket additionally defines a secondary debris collection chamber in flow communication with at least one weir for spillover flow of water and floating debris from the pool surface into and resultant capture of floating debris within the secondary collection chamber. A flow control valve assembly regulates the weir surface flow to insure that a sufficient flow is drawn through the pool cleaner for proper pool cleaner operation. A water level regulator float responds to the water level within the skimmer housing to variably open and close submerged auxiliary intake ports in the buoyant housing to maintain the water level therein generally between predetermined maximum and minimum limits. The collection basket is quickly and easily removable as needed to dispose of collected debris.

In the preferred form, the buoyant housing defines a water inlet port and a water outlet port generally at opposite sides thereof for in-line connection with the vacuum hose. The perforated collection basket is nestably received into the housing, and includes an inlet aperture aligned with the housing inlet port whereby water with entrained debris drawn from the pool cleaner passes through the inlet port into the primary debris collection chamber of the collection basket. The collection basket is configured to define the primary collection chamber with at least one perforate side wall disposed in spaced relation to the housing outlet port. With this construction, water can be drawn from the primary collection chamber through the perforate side wall and further through the outlet port to the pool filtration system, while entrapping and retaining sizable water-entrained debris within the primary collection chamber.

An internal and imperforate divider wall subdivides the debris collection basket into the primary and secondary debris collection chambers. An upper end of the collection basket carries a basket lid having an inlet opening to permit downward water flow from an upper weir chamber into the secondary collection chamber. A flow control valve assembly is mounted within the housing beneath the collection basket and includes a spring-loaded valve flap biased normally to a closed position preventing water flow through a perforated segment of the secondary collection chamber to the outlet port in the buoyant housing. During operation of the pool cleaner, a sufficient suction or negative pressure at the housing outlet port, or within the primary debris collection chamber, draws the valve flap to a partially open position to permit downward water flow from the upper weir chamber into the secondary debris collection chamber. This causes water and floating debris on the pool surface to be drawn over the weir for downward passage into the interior of the collection basket within the secondary collection chamber. The spring force urging the valve flap to the normal closed position is sufficient to prevent significant opening movement unless the suction pressure is sufficient to provide proper pool cleaner performance. An adjustment knob at the underside of the buoyant housing permits the spring force applied to the valve flap to be controllably adjusted.

The water level regulator float is mounted within the upper weir chamber in a position above the collection basket. The regulator float comprises a buoyant ring defining at least one radially open window for variable alignment with the auxiliary inflow ports formed in the buoyant housing. As the water level within the upper weir chamber falls, the buoyant ring descends for progressively opening the auxiliary inflow ports for additional water inflow into the housing. As the water level rises within the upper weir chamber, the buoyant ring ascends to progressively close the auxiliary inflow ports. In this manner, the water level within the upper weir chamber is maintained between the predetermined upper and lower level limits.

The collection basket is removable from the buoyant housing to permit debris collected therein to be emptied and discarded on a periodic or as-needed basis. In the preferred form, the water level regulator float is carried by a removable handle adapted for quick and easy lift-out removal of the collection basket from the housing. The handle and regulator float are then disassembled from the collection basket to permit quick and easy disposal of debris collected therein. The handle and regulator float are then re-assembled with the collection basket for slide-fit re-installation into the housing.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
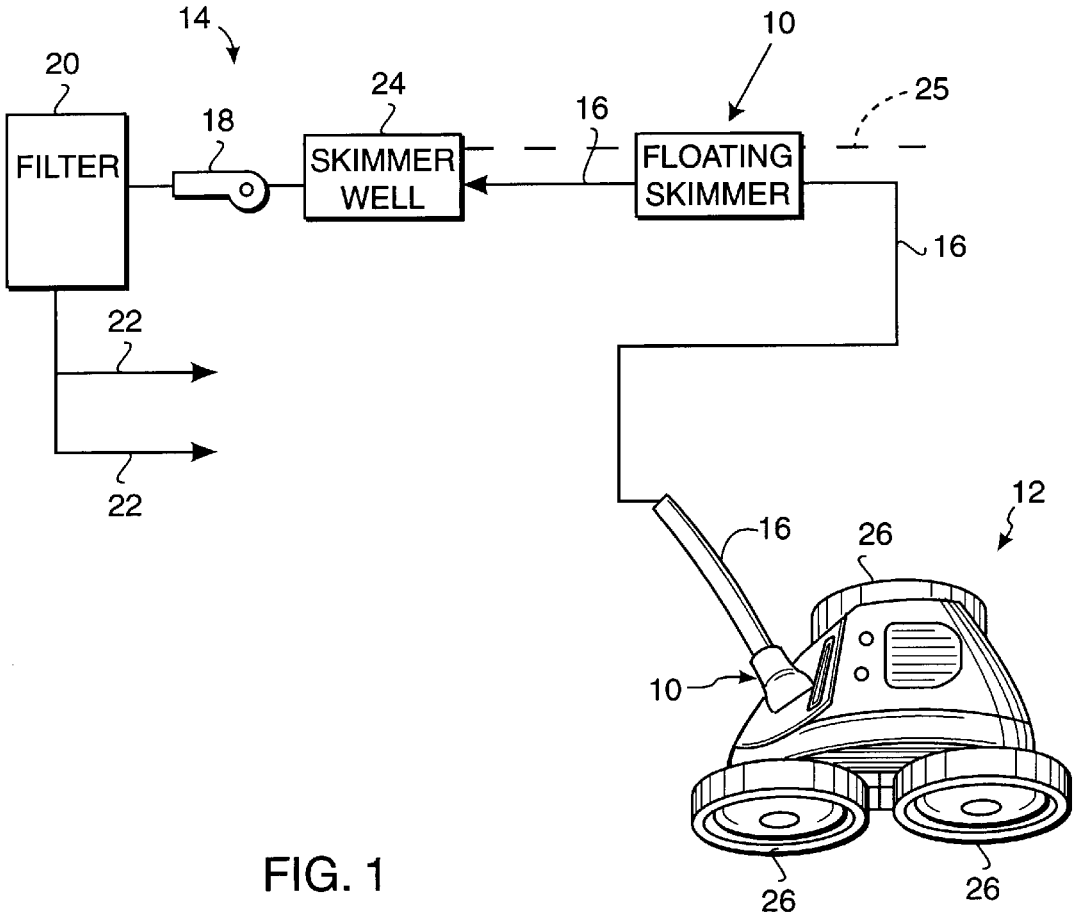
FIG. 1 is a schematic representation of a swimming pool filtration system in combination with a suction-powered pool cleaner for cleaning submerged pool floor and side wall surfaces, and further including a floating skimmer of the present invention.
Figure 2:
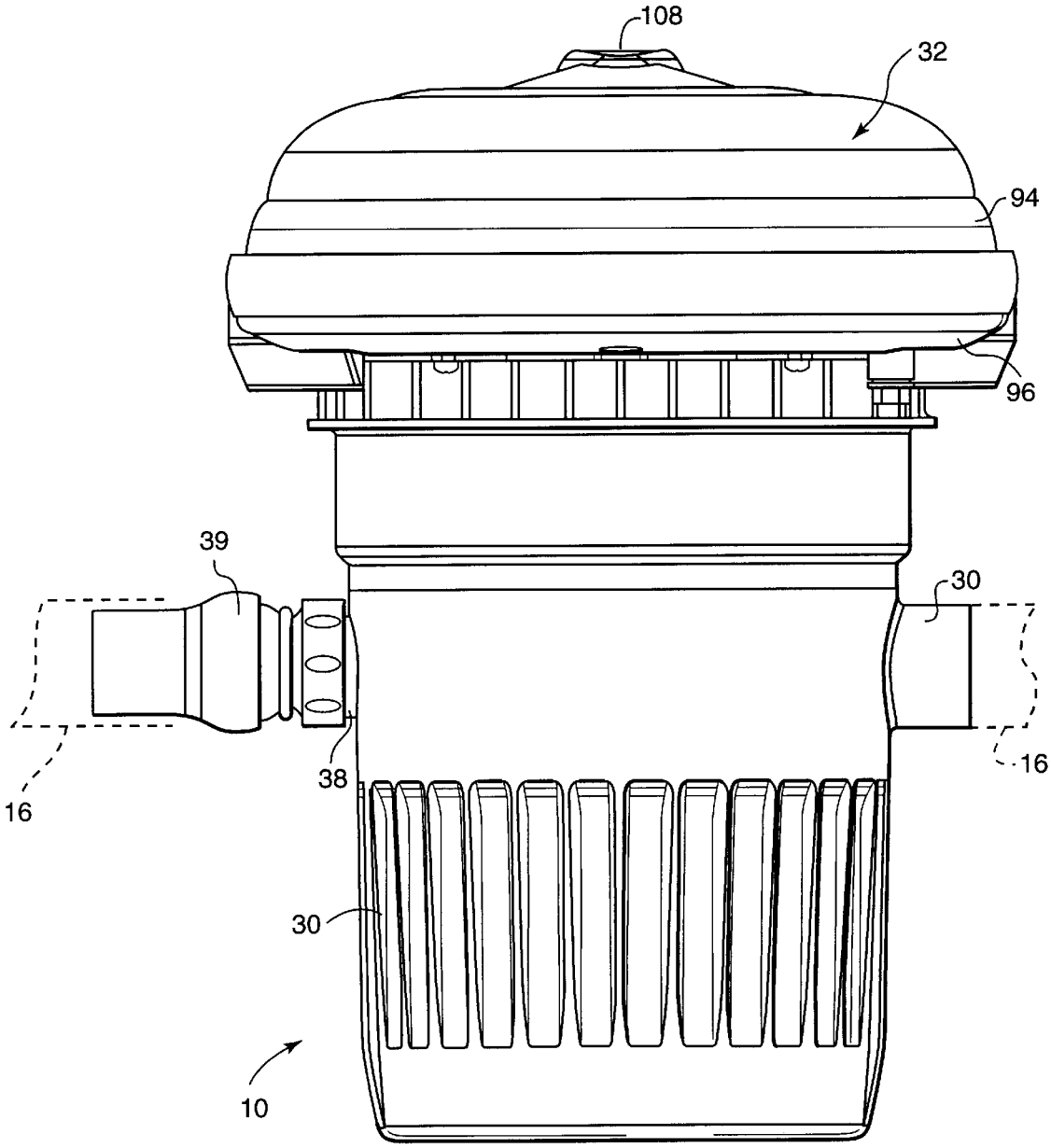
FIG. 2 is a front elevation view of the floating skimmer embodying the novel features of the invention.
Figure 3:
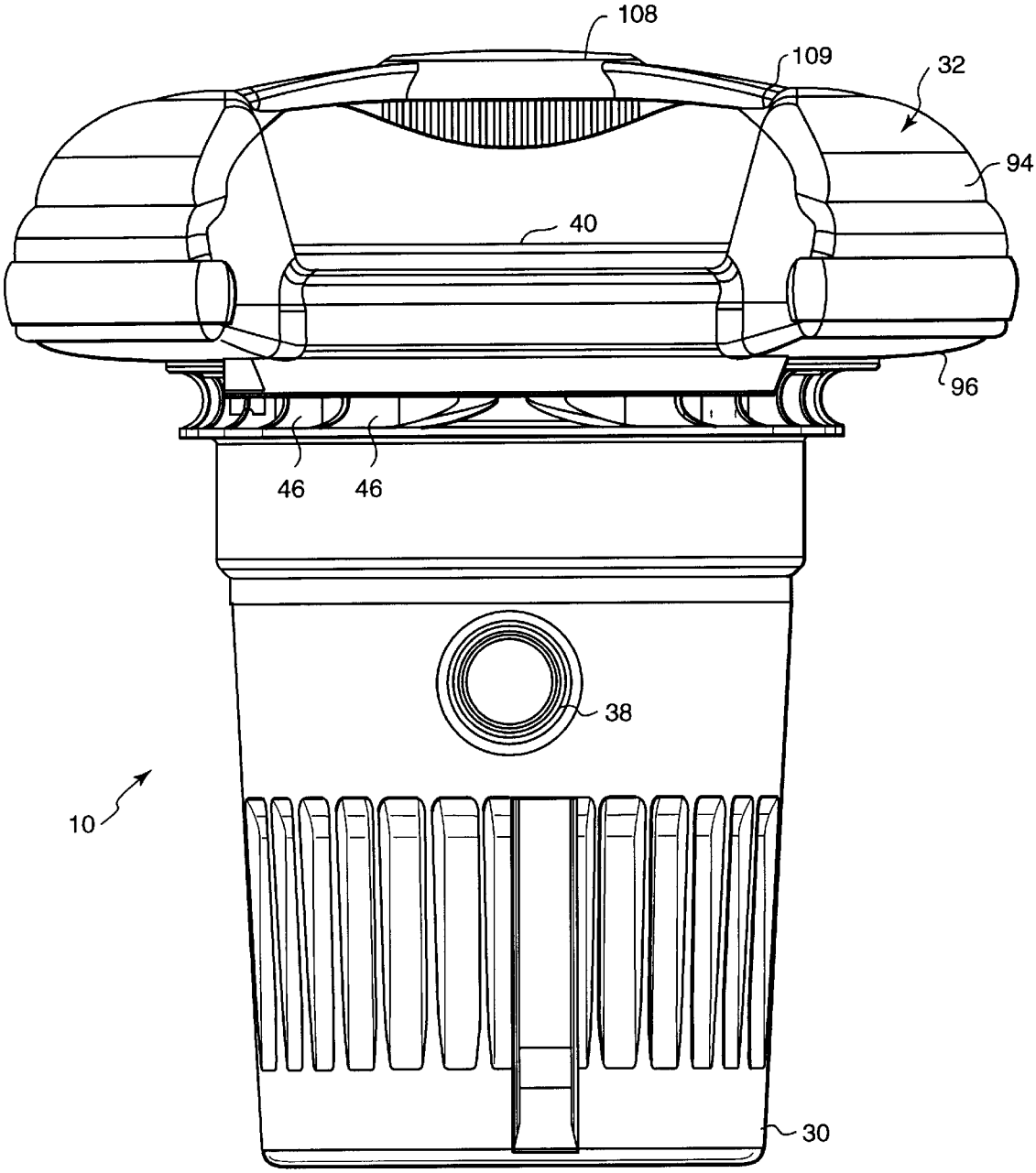
FIG. 3 is a left side elevation view of the floating skimmer shown in FIG. 2.
Figure 4:
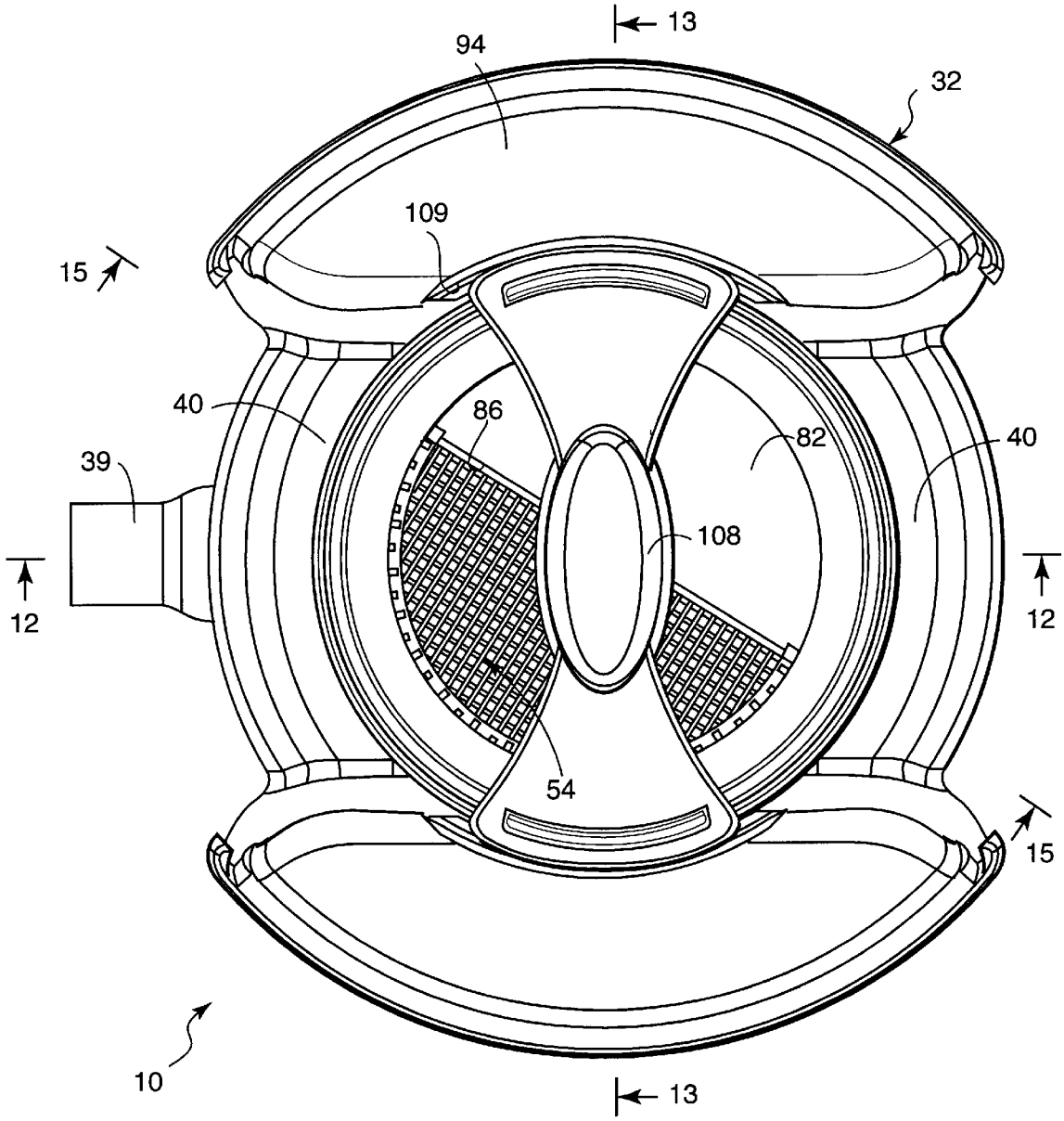
FIG. 4 is a top plan view of the floating skimmer shown in FIG. 2.
Figure 5:
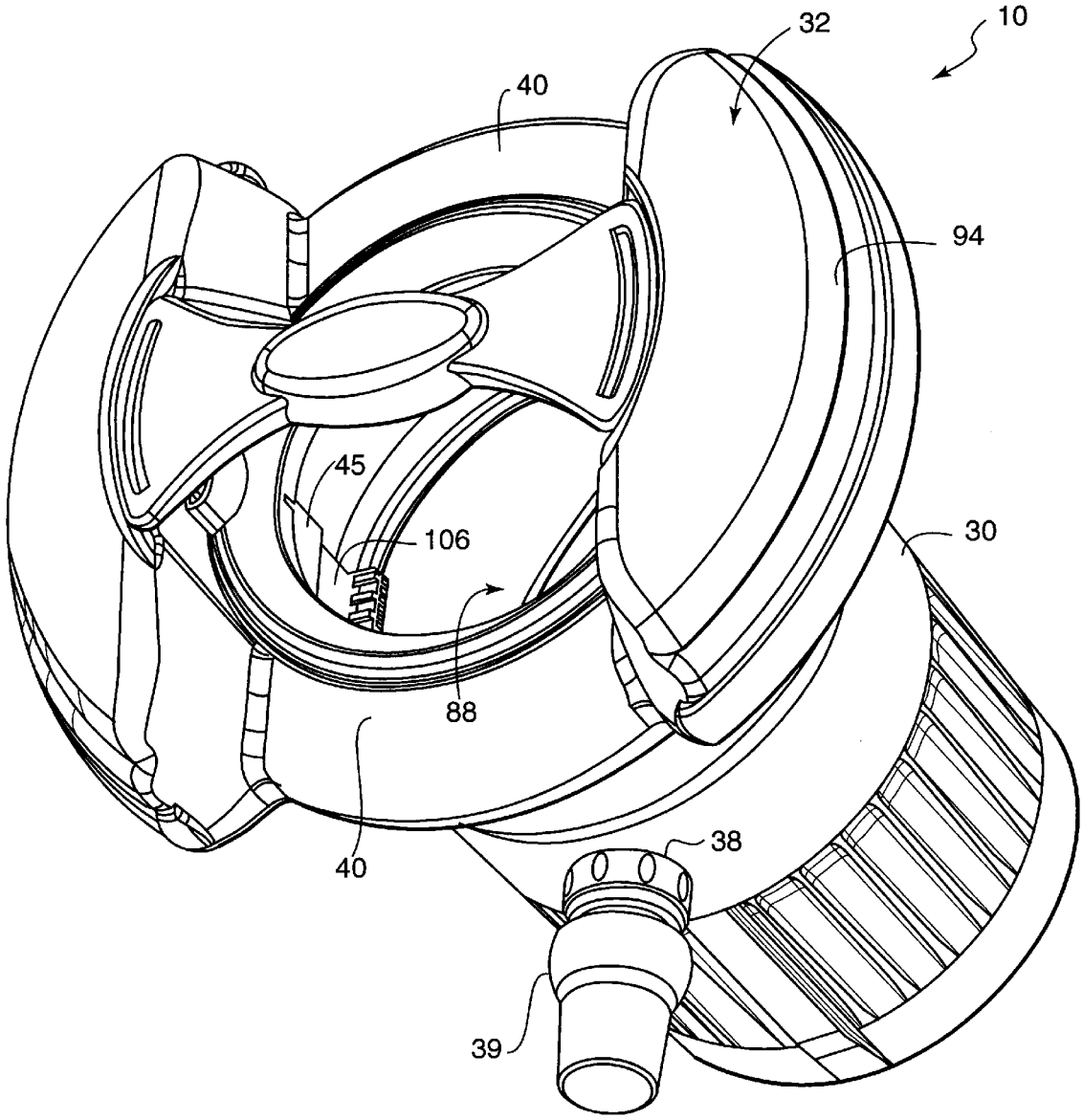
FIG. 5 is a top perspective view of the floating skimmer shown in FIG. 2.
Figure 6:
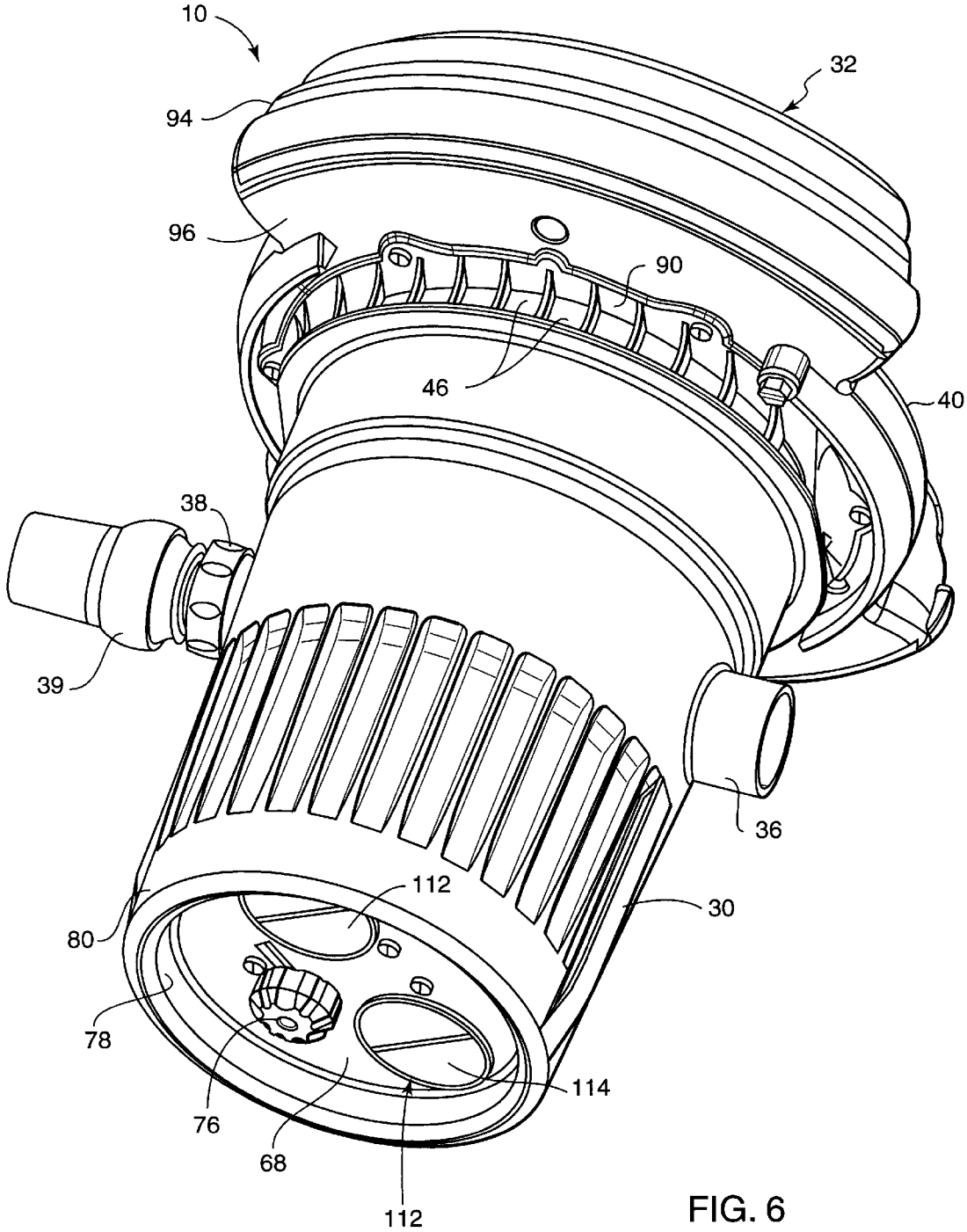
FIG. 6 is a bottom perspective view of the floating skimmer shown in FIG. 2.

As shown in the exemplary drawings, a floating skimmer referred to generally in FIGS. 1–7 by the reference numeral 10 is provided for use in a water filtration and cleaning system for a swimming pool or the like, wherein the floating skimmer 10 is used in combination with a pool cleaner 12 (FIG. 1) of the suction-powered type for vacuuming debris such as leaves and twigs as well as small particulate such as sand and silt settled onto submerged floor and wall surfaces of the swimming pool. The pool cleaner 12 is powered by a suction or vacuum source, such as a conventional pool water filtration system 14 as depicted schematically in FIG. 1, by connection to the filtration system via a vacuum hose 16. The floating skimmer 10 is mounted in-line along the length of the vacuum hose 16, and functions to capture debris picked up by the pool cleaner 12 as well as to skim and collect floating debris such as leaves and the like from the surface of the pool water.

The pool water filtration system 14 (FIG. 1) conventionally includes a pump 18 for drawing water from the swimming pool for passage through a filter canister 20 having a selected filtration media (not shown) contained therein for capturing and collecting silt and grit and other particulate debris matter entrained in the water flow stream. The thus-filtered water is then recirculated to the swimming pool through one or more return conduits 22. In a typical water filtration system, at least a portion of the water drawn from the pool by the pump 18 is drawn through a skimmer well 24 which is normally mounted at one edge of the pool generally at the water's surface 25 and includes a weir (not shown in FIG. 1) over which water is drawn to skim and collect debris floating on the surface of the pool water.

When a suction-powered pool cleaner 12 is coupled with the filtration system 14 for enhanced cleaning of pool surfaces, the vacuum hose 16 is often connected (as viewed schematically in FIG. 1) to extend between the skimmer well 24 and the pool cleaner, whereby water is not drawn over the weir within the skimmer well and the normal surface skimming function is thus disabled. Alternately, it will be recognized and understood that some swimming pools may be equipped with a dedicated suction cleaner flow line (not shown) coupled directly from the pool wall to the filtration system 14, in which case the vacuum hose 16 would be coupled to said suction flow line. In either case, the filtration system 14 draws water from the swimming pool through the cleaner 12 and further through the vacuum hose 16 to the pump 18 for delivery in turn to the filter canister 20. This vacuum or suction water flow drawn through the pool cleaner 12 provides a power source for driving the pool cleaner in a manner achieving substantially random travel of the cleaner throughout the pool to dislodge and vacuum debris settled upon submerged pool floor and side wall surfaces. While the specific type of suction-powered pool cleaner may vary, one preferred pool cleaner is available from Polaris Pool Systems, Inc., of Vista, Calif. under product designation Model 340. See also copending U.S. Ser. No. 09/090,894, filed Jun. 4, 1998, which is incorporated by reference herein. Such pool cleaner, as illustrated generally in FIG. 1, incorporates internal drive means (not shown) for rotatably driving one or more cleaner wheels 26 for transporting the pool cleaner throughout the pool, together with means for vacuuming settled debris to the vacuum hose 16. Other exemplary suction powered pool cleaners are shown and described, by way of example, in U.S. Pat. Nos. 3,803,658; 4,023,227; 4,133,068; 4,208,752; 4,643,217; 4,679,867; 4,729,406; 4,761,848; 5,105,496; 5,265,297; and 5,634,229. See also copending U.S. Ser. No. 09/176,532, filed Oct. 21, 1998.

In general terms, the floating skimmer 10 of the present invention is installed in-line along the length of the vacuum hose 16. The floating skimmer 10 is designed to float at the surface 25 of the pool water, and to effectively trail the pool cleaner 12 as it moves randomly about the swimming pool during normal cleaning operation. The floating skimmer functions to skim the water surface to collect and trap floating debris within a perforated collection basket 28 (FIGS. 7–15, 17–18 and 20–24), while additionally capturing large or sizable debris picked up by the pool cleaner 12 within the collection basket 28. This collection basket can be periodically pulled from the skimmer 10 on an as-needed basis to empty and discard the contents thereof, followed by quick and easy basket replacement for resumed debris collection.

Figure 7:
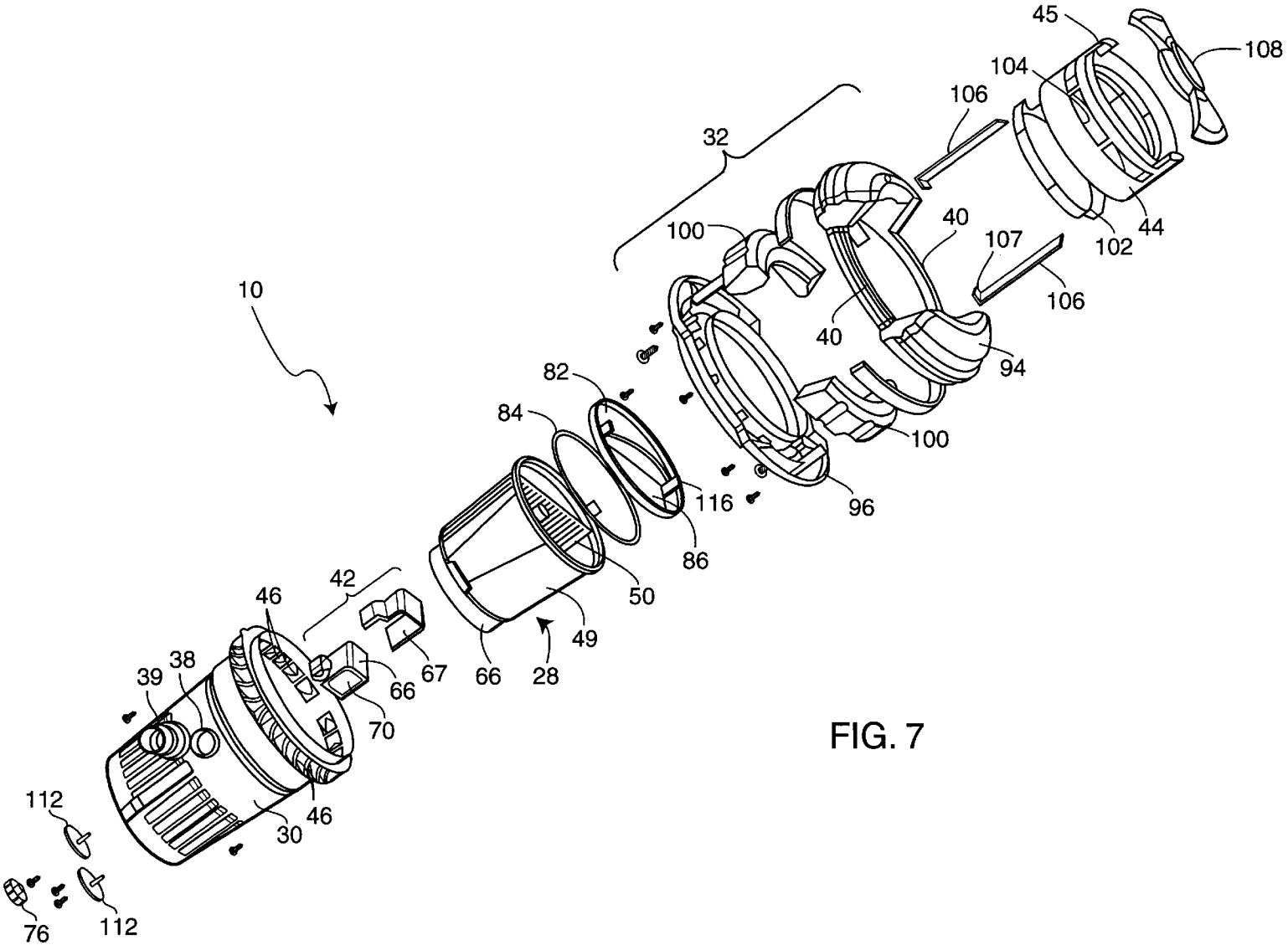
FIG. 7 is an exploded perspective view illustrating assembly of components for the floating skimmer.

As shown best in FIG. 7, the floating skimmer 10 generally comprises a buoyant skimmer housing of lightweight molded plastic or the like, to include an upwardly open lower bucket or pail-shaped container housing 30 having a combination float/ballast assembly 32 mounted at an upper end thereof. The lower skimmer housing 30 defines a hollow interior 34 (FIGS. 7, 9 and 10) within which the collection basket 28 is removably mounted. A water inlet port 36 is formed at one side of the lower housing 30 for connection to the segment of the vacuum hose 16 (as viewed in dotted lines in FIG. 2) extending from the pool cleaner 12, to permit inflow of water and entrained debris from the pool cleaner into the interior of the collection basket 28 to capture debris therein as will be described in more detail. A water outlet port 38 is formed at an opposite side of the lower housing 30 for connection to the vacuum hose segment leading to the pool filtration equipment. As shown, this water outlet port 38 may comprise an externally threaded fitting of the type adapted for connection to a swivel coupling 39 (FIG. 2), such as a swivel coupling of the type shown and described in copending U.S. Ser. No. 60/118,391, filed Feb. 1, 1999, and incorporated by reference herein.

The float/ballast assembly 32 defines at least one and preferably a pair of weirs 40 (FIGS. 3–5, 7 and 12–14) at diametrically opposed positions for spillover water flow from the surface 25 of the pool water into the upwardly open interior of the lower skimmer housing 30. In this regard, water is drawn over the weirs 40, and also from the pool cleaner 12, by virtue of the vacuum hose connection of the outlet port 38 to the suction side of the pool filtration equipment 14. An adjustable flow control valve assembly 42 (FIGS. 7–10, 12–15 and 17–18) is provided and functions as will be described in more detail to proportion and regulate water flow over the weirs 40 in a manner assuring that a sufficient and substantially constant suction pressure is coupled to the pool cleaner 12 to draw a sufficient water flow through the pool cleaner 12 for adequate and proper pool cleaner operation. The flow control valve assembly 42 permits a portion of the suction water flow, when sufficient pump capacity is present, to be drawn over the weirs 40 for waterfall-like passage into the interior of the skimmer housing 30 to collect floating surface debris in the collection basket 28. Importantly, a water level regulator float 44 (FIGS. 7, 12–15 and 20–21) is movably positioned within the skimmer housing 30 above the collection basket 28 and responds to the water level within the skimmer to variably open or close a circumferential array of auxiliary inflow ports 46 (FIGS. 2, 3, and 6–15) formed at a normally submerged position in the skimmer housing 30 in a manner assuring that the skimmer water level remains above the level of the inlet and outlet ports 36, 38.

More specifically, as shown in FIGS. 7–10, the collection basket 28 may be constructed conveniently and economically from lightweight molded plastic or the like to define an upwardly open and generally cylindrical container having a large number of perforations 48 formed in an arcuate portion of the upstanding cylindrical side wall 49 thereof, and a diametric size and shape to nest within the lower skimmer housing 30 in a position fitted into the hollow interior 34 thereof. The interior of the collection basket 28 is subdivided by an internal imperforate divider wall 50 into a primary debris collection chamber 52 separated from a secondary debris collection chamber 54. The perforations 48 are formed in the portion of the basket side wall 49 which cooperates with the divider wall 50 to define the primary debris collection chamber 52. By contrast, the remaining portion of the side wall 49 cooperates with the divider wall 50 to define the secondary debris collection chamber 54, and this remaining portion of the side wall 49 has an imperforate construction (shown best in FIGS. 9, 10 and 24). A floor segment 56 is joined to a lower end of the basket side wall 49 and the internal divider wall 50, and this floor segment 56 has perforations 58 formed therein on both sides of the divider wall 50 (shown in FIGS. 8, 12–15 and 17–18).

A central region of the floor segment 58 of the collection basket 28 is dished upwardly, as shown in FIGS. 8, 10, 12–15 and 17–18, for accommodating the flow control valve assembly 42 at the bottom of the skimmer housing 30, when said collection basket 28 is installed into the housing 30. In this regard, a spacer wall 60 (shown best in FIG. 8) protrudes downwardly a short distance from the imperforate portion of the basket side wall 49 and has opposite ends inturned radially toward each other and disposed in spaced relation to accept the flow control valve assembly 42 therebetween, as will be described in more detail. This spacer wall 60 thus has a non-symmetric configuration protruding from the bottom of the collection basket 28. A matingly shaped pocket 62 (shown best in FIG. 10) is formed at the interior bottom of the skimmer housing 30 for nested reception of the spacer wall 60, when the collection basket 28 is installed into the housing 30 with a downward slide-fit motion. With this geometry, the basket 28 fits into the skimmer housing 30 in a single predetermined rotational position relative to the housing 30 so that an inlet aperture 63 (FIGS. 9 and 12) formed in the perforate portion of the basket side wall 49 is substantially aligned with the inlet port 36 formed in the skimmer housing 30.

With this construction, during operation of the floating skimmer 10, water with entrained debris is drawn from the pool cleaner 12 through the inlet port 36 and the basket inlet aperture 63 into the primary collection chamber 52 of the basket 28 for capturing and retaining water-entrained debris therein. Importantly, the perforated segment of the upstanding side wall 49 of the collection basket 28 is spaced at least slightly from the interior of the skimmer housing 30 and the outlet port 38 formed therein (FIGS. 12 and 14), to permit water to pass outwardly from the primary collection chamber 52 through the basket perforations 48 to the outlet port 38 for flow further to the pool filtration equipment. With this arrangement, the collection basket 28 effectively captures and traps large or sizable debris entrained in the water flow stream from the pool cleaner, to prevent such large debris from passing further to the filter canister 20.

Figure 8:
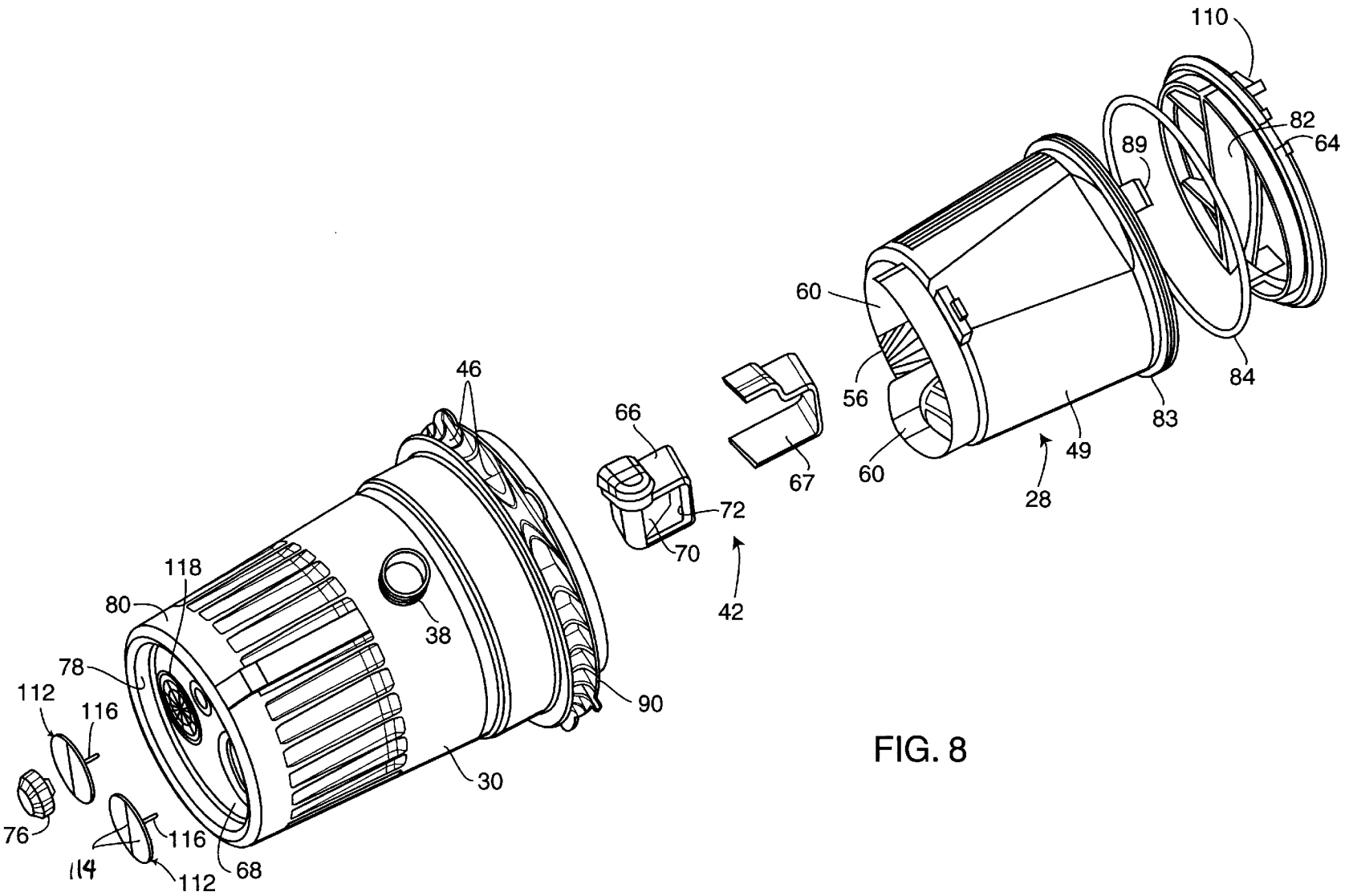
FIG. 8 is an enlarged exploded bottom perspective view illustrating assembly of a perforated collection basket and a related flow control valve assembly into a hollow housing for the floating skimmer.
Figure 18:
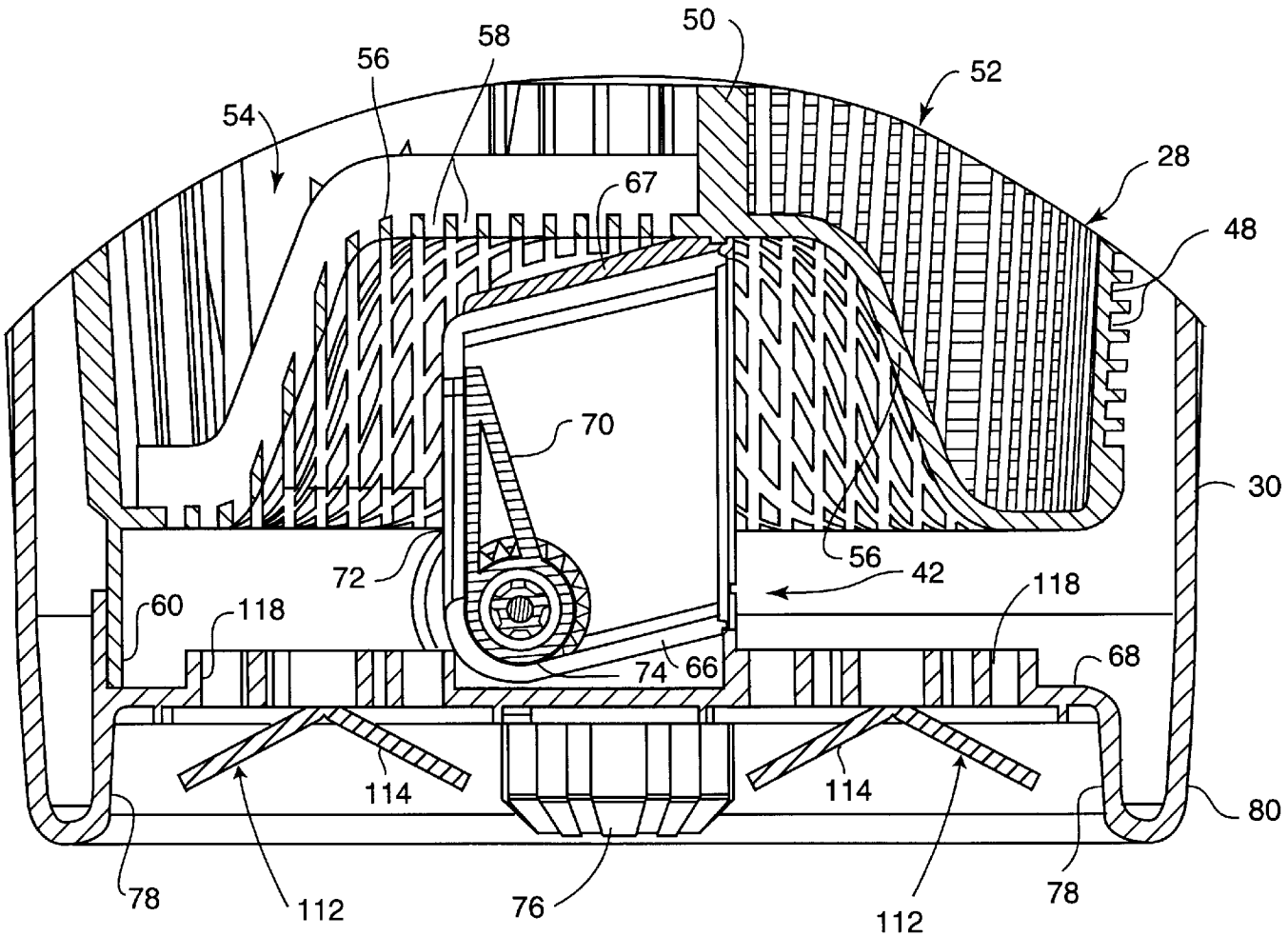
FIG. 18 is an enlarged fragmented vertical sectional view similar to FIG. 17, but showing the flow control valve in a closed position and further illustrating a pair of drain valves in an open position for draining water from the primary and secondary debris collection chambers of the floating skimmer.
Figure 19:
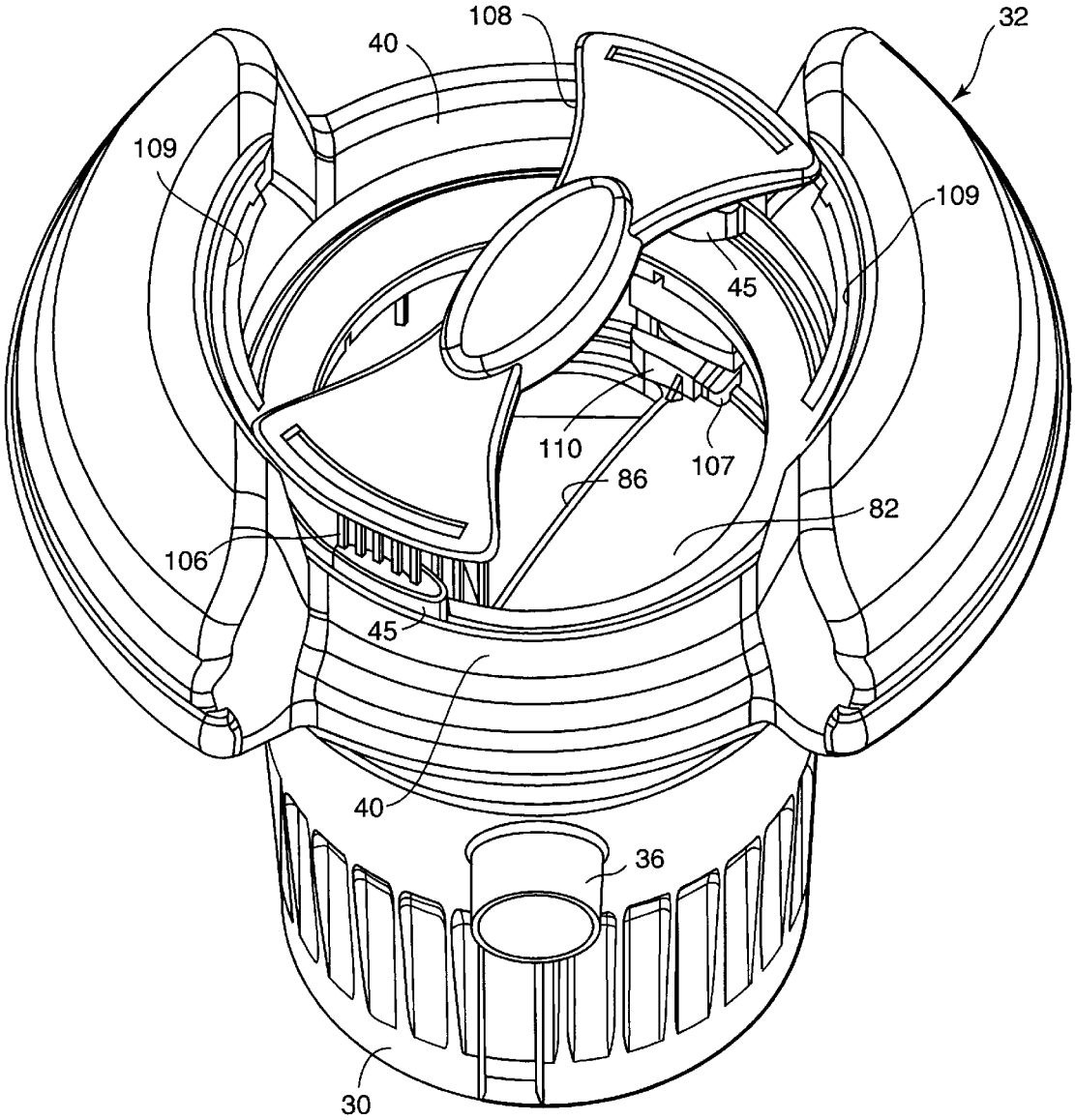
FIG. 19 is a top perspective view similar to FIG. 5, and illustrating handle rotation to a position permitting lift-out removal of the collection basket from the skimmer housing.

The flow control valve assembly 42 is mounted within a lower region or transition chamber within the skimmer housing 30 defined by the raised or upwardly dished floor segment 56 of the collection basket 28, when the collection basket 28 is installed into the skimmer housing. In this regard, as shown best in FIGS. 8–9, 12–15, and 17–18, the flow control valve assembly 42 comprises a valve housing 66 mounted by a bracket 67 attached in a suitable manner by screws (not shown) or other suitable fastening means to a bottom wall 68 of the skimmer housing 30, in a position to bridge or nest snugly between the aligned inturned ends of the spacer wall 60 (FIG. 8) on the bottom of the collection basket 28 when said basket is installed into the skimmer housing 30. The flow control valve assembly 42 further includes a movable valve member such as a valve flap 70 mounted pivotally on the valve housing 66 for opening and closing a gate port 72 formed therein (FIG. 8). In the preferred form, the valve flap 70 is normally biased by a spring 74 (FIGS. 17–18) toward a normal position closing the gate port 72 (FIG. 18). Accordingly, in this normally closed position, the valve flap 70 isolates or separates the lower end of the secondary debris collection chamber 54 from the primary debris collection chamber 52. However, when the valve flap 70 is in an open position (FIGS. 12–15 and 17), water flow is permitted in a downward direction from the secondary collection chamber 54 through the portion of the perforated raised floor segment 56 aligned therewith, and further through the transition chamber and gate port 72 and back upwardly through the opposite portion of the perforated floor segment 56 into the primary collection chamber 52.

In operation, the valve flap 70 is drawn from the spring-biased normally closed position to a modulated partially open position by the suction pressure which is present in the primary collection chamber 52. In accordance with one aspect of the invention the specific spring force applied by the spring 74 to urge the valve flap 70 to the normally closed position can be adjustably set by rotating an adjustment knob 76 to increase or decrease the applied spring force by winding or unwinding the spring 74. Although the specific geometry of the adjustment knob 76 and related biasing spring 74 may vary, one preferred configuration is shown and described in copending U.S. Ser. No. 60/117,069, filed Jan. 25, 1999, which is incorporated by reference herein. The adjustment knob 76 is desirably and conveniently located at the bottom exterior of the skimmer housing 30 within a shallow recess 78 for easy access, with a peripheral skirt 80 conveniently extending downwardly from the housing bottom wall 68 for protecting the adjustment knob against impact damage or the like. As shown and described in copending U.S. Ser. No. 60/117,069, the adjustment knob 76 may be normally locked against rotation but can be depressed to permit knob rotation in a selected direction for winding or unwinding the spring 74 thereby respectively increasing or decreasing the closure force applied to the valve flap 70, as desired. Alternately, the adjustment knob 76 may be coupled via a worm gear or the like to the adjustable biasing spring 74, wherein the worm gear may be designed for substantially self-locking operation to resist inadvertent positional adjustment during operation.

The upper end of the collection basket 28 has a lid 82 mounted thereon (FIGS. 7–15 and 19–24). The lid 82 comprises a generally circular plate having a size and shape to overlie and engage an upper peripheral rim 83 of the basket 28 as well as an upper marginal edge of the divider wall 50. A seal member such as an O-ring seal 84 or the like is captured within a radially outwardly open channel formed by the basket rim 83, for sealingly engaging the interior of the skimmer housing 30 when the basket 28 is slide-fit mounted therein. A peripheral rim 85 on the basket lid 82 has a size and shape for nested fit with the basket rim 83 (FIGS. 12–15 and 21–24). An inlet opening 86 is formed in the lid 82 to accommodate downward water flow from above the basket 28, through the inlet opening 86 and into the secondary debris collection chamber 54. Importantly, this inlet opening 86 is not vertically aligned with and thus does not accommodate downward water flow into the primary debris collection chamber 52. To insure alignment of the inlet opening 86 with the secondary collection chamber 54, a downwardly open channel 87 (FIGS. 12–14) may be provided on the underside of the lid 82 to receive the upper margin of the inner divider wall 50. In addition, a pair of diametrically opposed latch ports 64 (FIG. 24) are formed in the lid rim 85 for snap-fit reception of latch tabs 89 projecting upwardly from the basket periphery 83. Accordingly, particularly during normal operation with a vacuum or suction pressure within the underlying primary collection chamber 52, the basket lid 82 effectively closes and seals the upper end of the primary collection chamber 52, so that water flow therethrough is confined to passage between the inlet port 36 and outlet port 38 formed on the skimmer housing 30. However, the basket lid 82 permits downward water flow through the lid opening 86 into the secondary collection chamber 54.

FIGS. 7–11 and 20–21 illustrate slide-fit installation of the collection basket 28 into the hollow interior of the skimmer housing 30, in the predetermined rotational orientation as previously described with the basket inlet aperture 63 aligned with the inlet port 36 on the housing 30. In this position, the flow control valve assembly 42 is disposed beneath the perforated raised floor segment 56 of the basket 28. The housing lid 82 is positioned on the top of the basket 28, with the inlet opening 86 in the lid aligned with the underlying secondary debris collection chamber 54. In this orientation, as shown best in FIG. 11, the basket lid 82 is located in spaced relation below an upper marginal edge of the skimmer housing 30.

The space within the skimmer housing 30 disposed above the installed collection basket 28 and associated lid 82 defines an upper weir chamber 88 (FIGS. 12–15). The water flow regulator float 44 is mounted within this upper weir chamber 88 and functions to control water flow into this chamber 88 through the circumferentially arranged set of auxiliary intake or inflow ports 46 formed about the periphery of the housing 30 near an upper end thereof.

Figure 10:
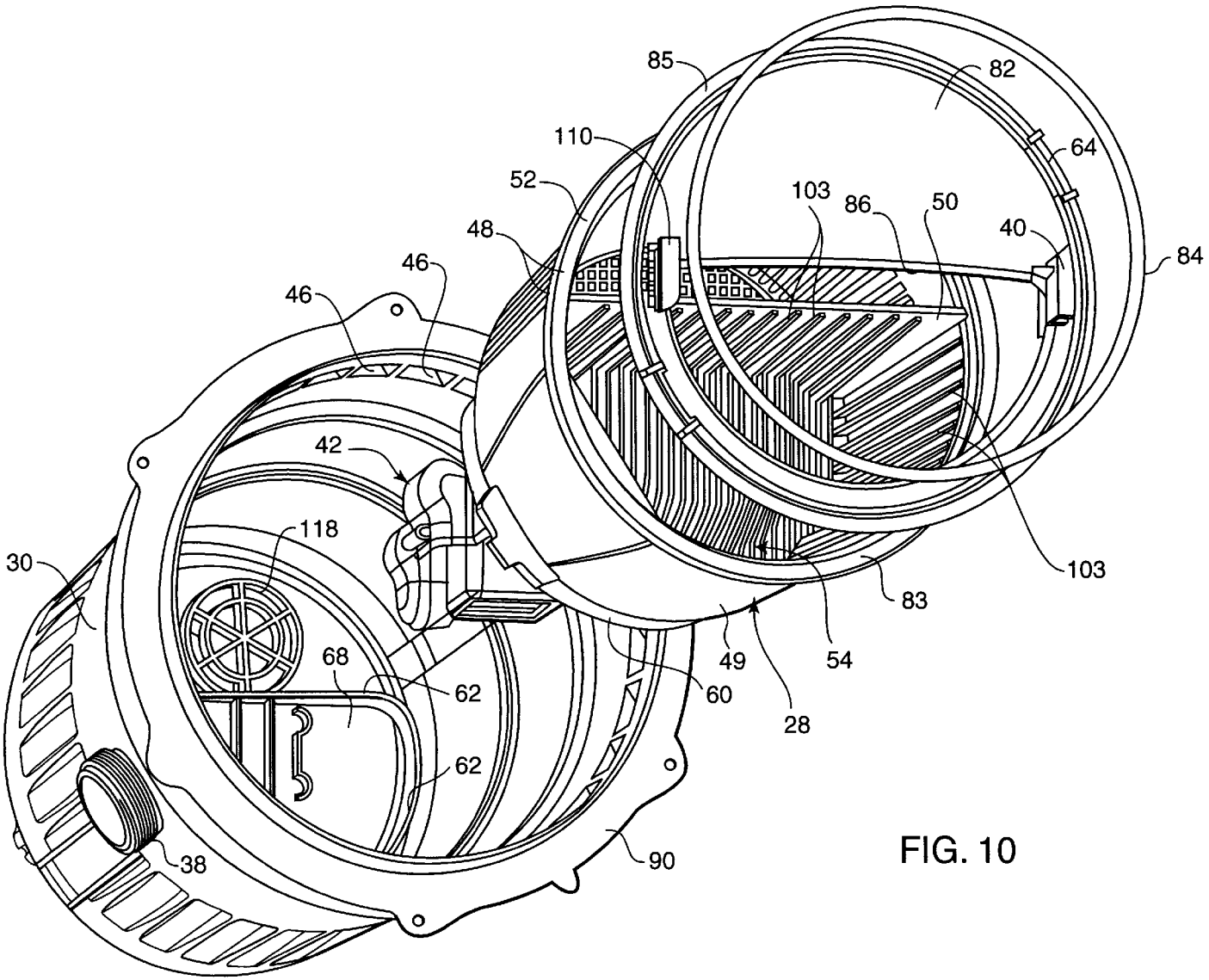
FIG. 10 is another exploded top perspective view illustrating assembly of the components shown in FIGS. 8 and 9, and further depicting interior construction details of the hollow housing.
Figure 11:
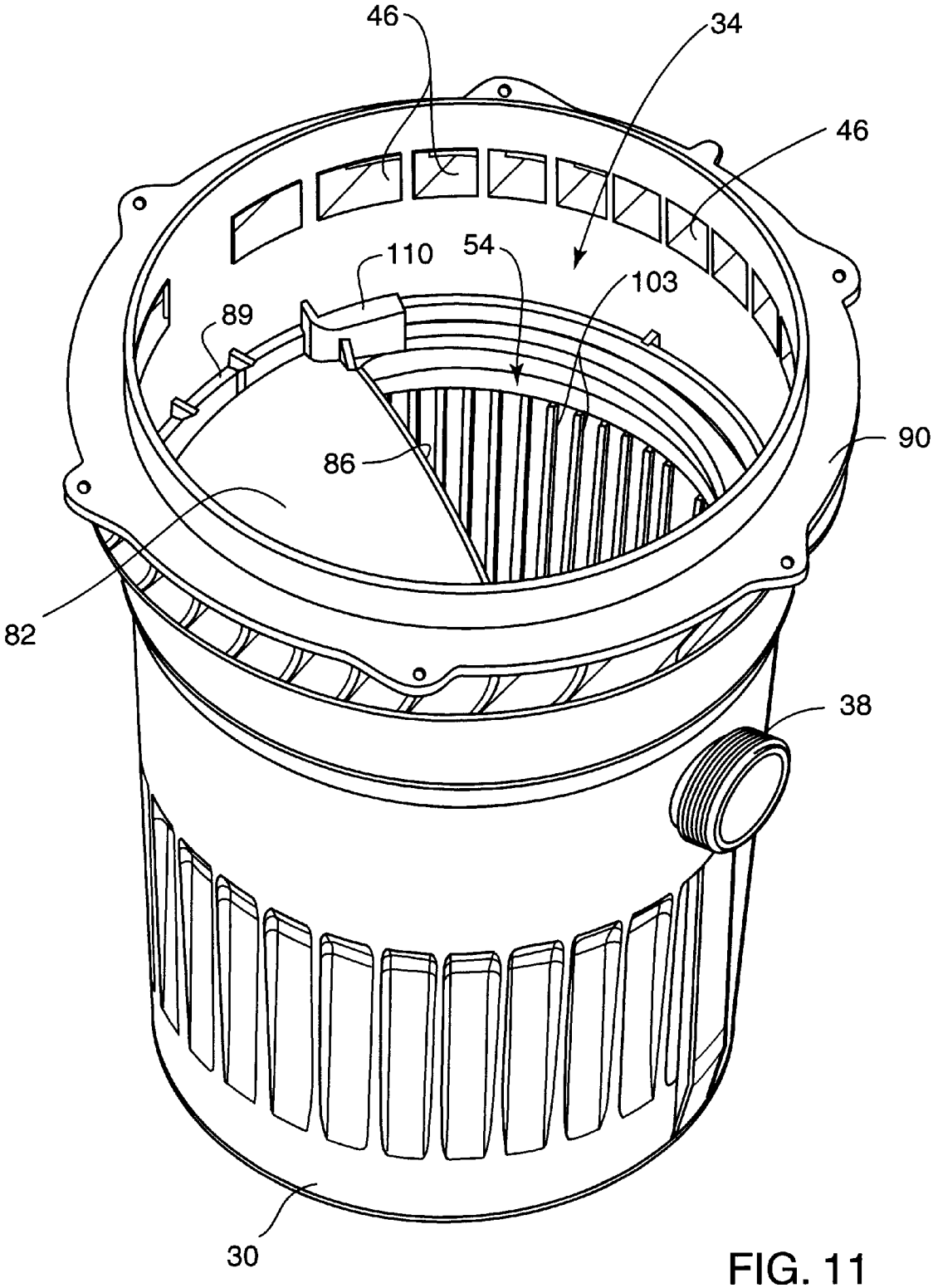
FIG. 11 is a top perspective view showing the perforated collection basket installed within the hollow housing for the floating skimmer.
Figure 12:
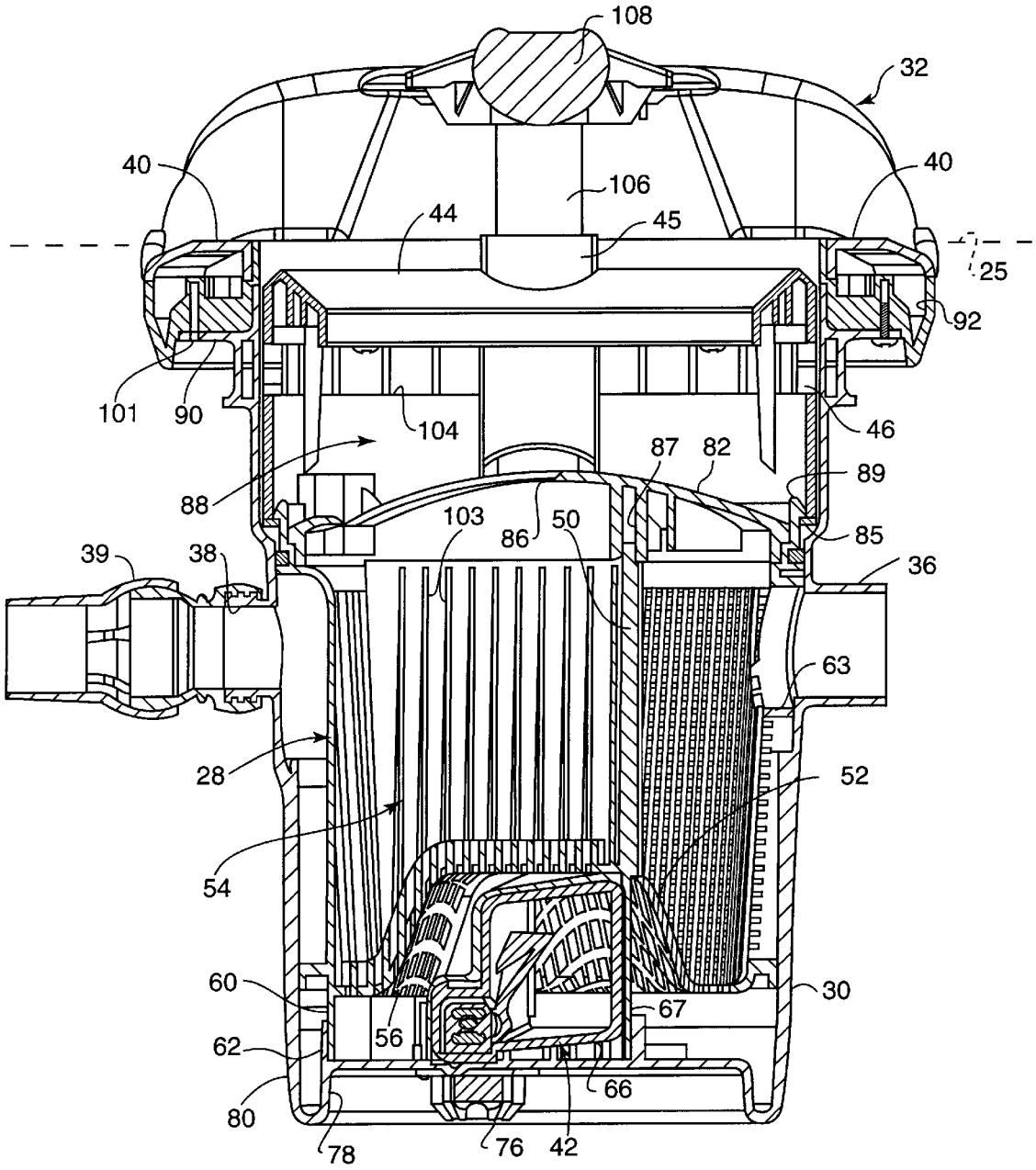
FIG. 12 is a fragmented vertical sectional view taken generally on the line 12—12 of FIG. 4, illustrating a water level regulator float mounted within an upper weir chamber formed in the skimmer housing at a location above the collection basket, and depicting the regulator float in a lower position to permit water inflow through auxiliary inflow ports formed in the skimmer housing.
Figure 13:
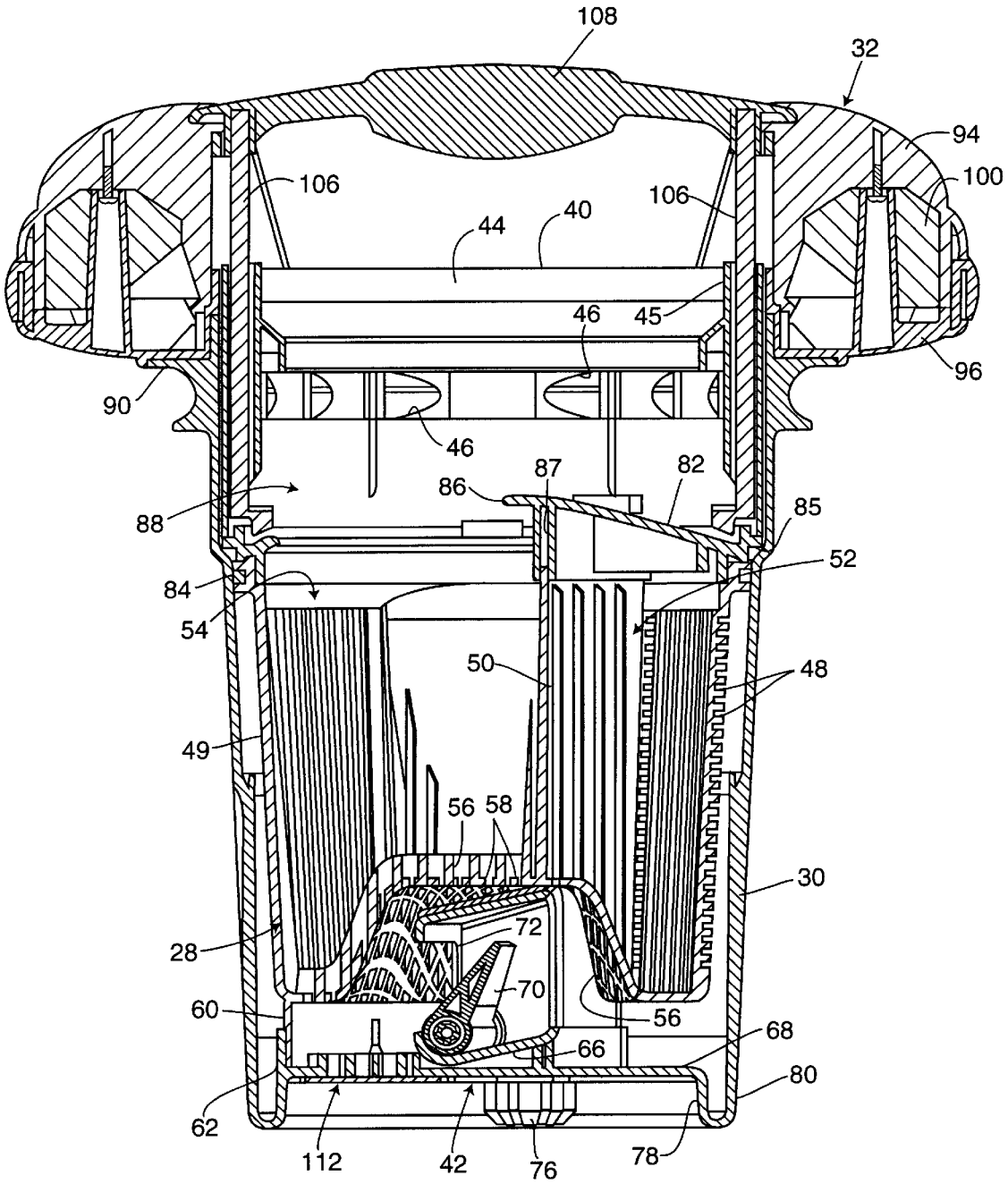
FIG. 13 is a fragmented vertical sectional view taken generally on the line 13—13 of FIG. 4, and showing slide-fit mounting of the water level regulator float on a removable handle.
Figure 14:
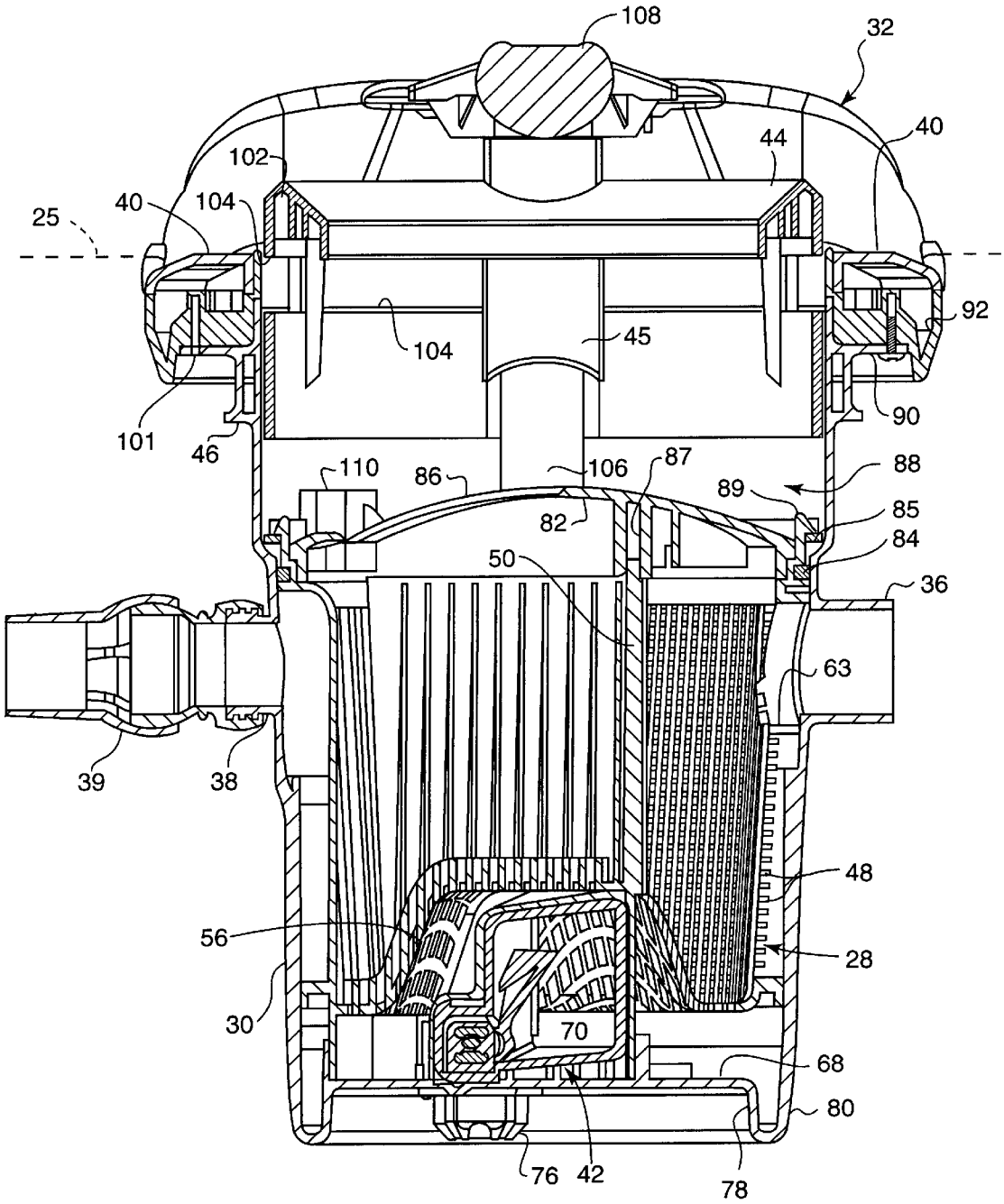
FIG. 14 is a fragmented vertical sectional view similar to FIG. 12, but illustrating the water level regulator float in an upper or raised position to restrict water inflow to the upper weir chamber through the auxiliary inflow ports.
Figure 15:
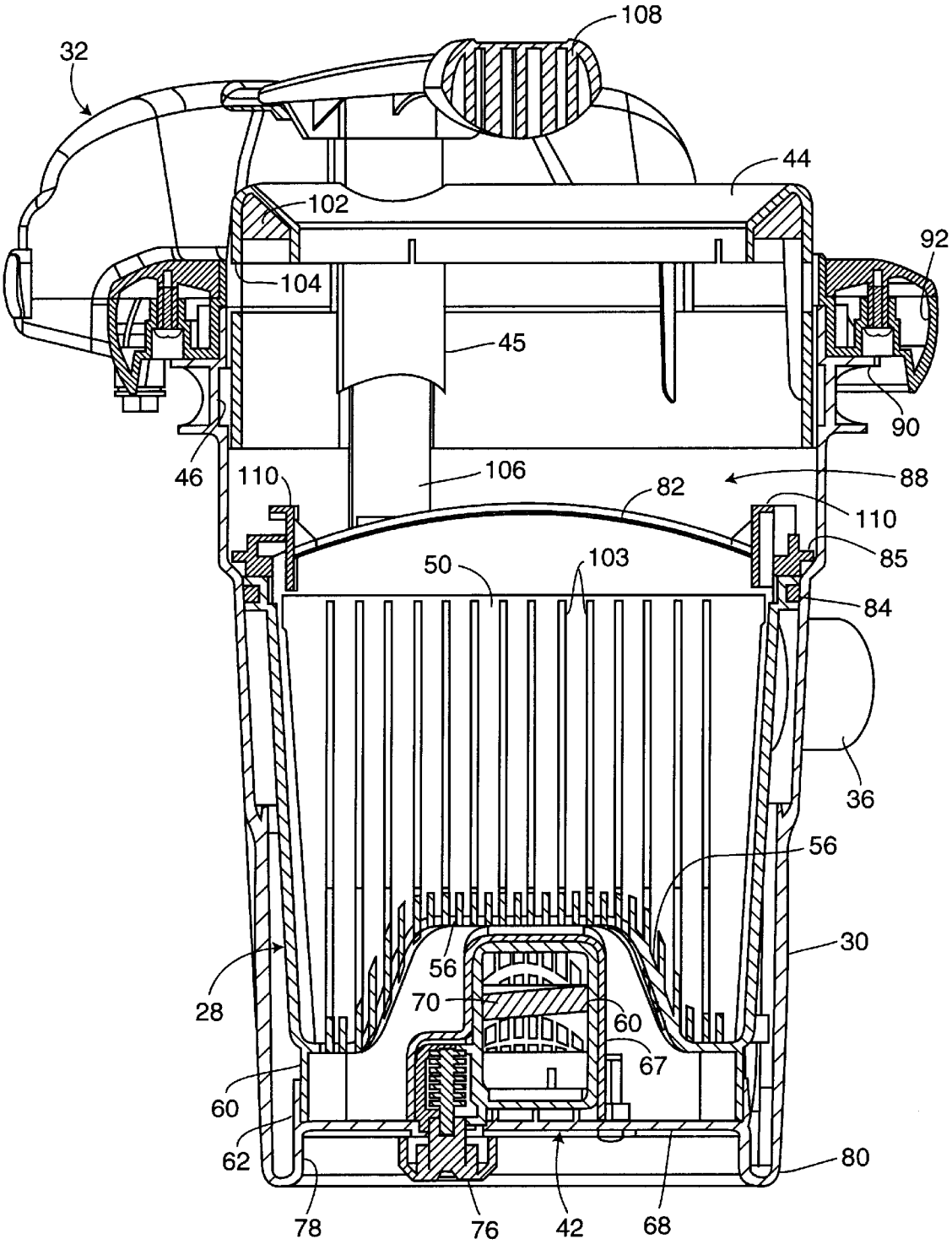
FIG. 15 is a fragmented vertical sectional view taken generally on the line 15—15 of FIG. 4.
Figure 16:
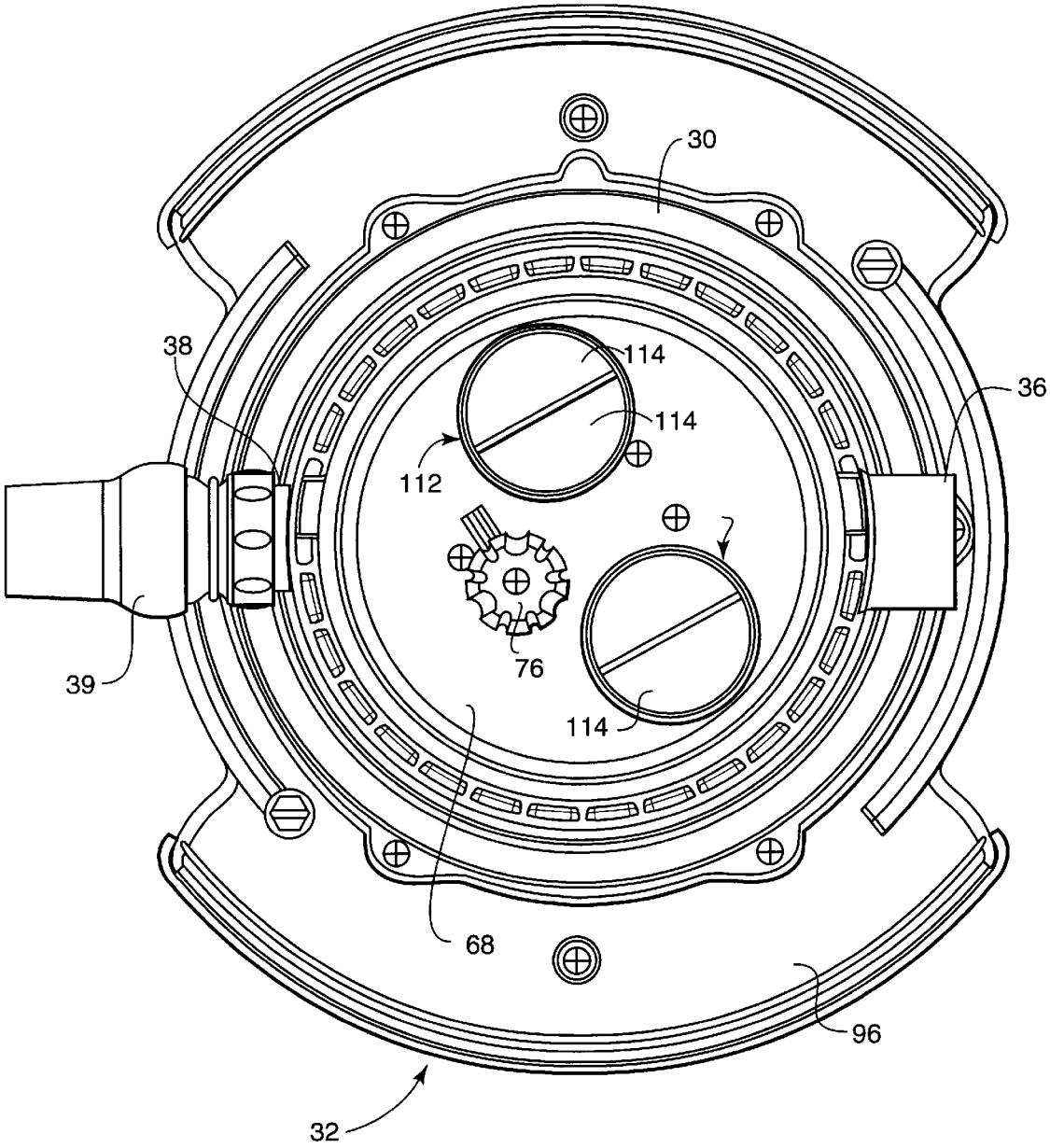
FIG. 16 is a bottom plan view of the floating skimmer.
Figure 17:
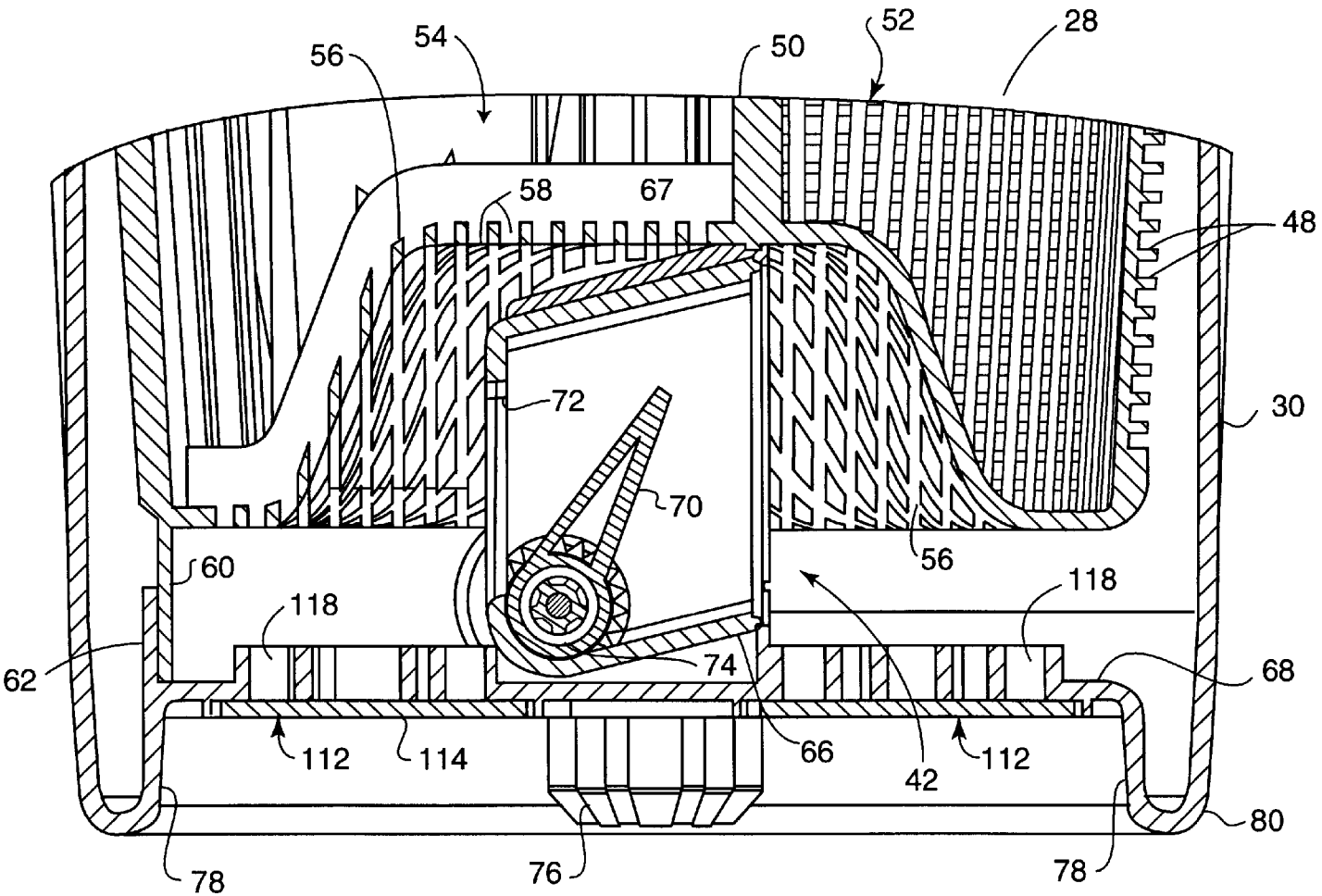
FIG. 17 is an enlarged fragmented vertical sectional view showing a lower portion of the floating skimmer, with a flow control valve depicted in an open position to regulate water flow from a secondary debris collection chamber to a primary debris collection chamber defined by the collection basket.

More particularly, water flows into the upper weir chamber 88 of the skimmer housing 30 by waterfall or spillover passage over the weirs 40. In this regard, the float/ballast assembly 32 comprises a ring-like structure mounted securely onto an upper rim flange 90 of the skimmer housing 30 (FIGS. 10–15). The float/ballast assembly 32 comprises a plurality of hollow ballast chambers 92 (FIGS. 12–14) which may conveniently be defined between upper and lower ballast segments 94 and 96 (FIGS. 7 and 12–14). Some of the hollow ballast chambers 92 may be filled with a weighted ballast and others may comprise flotation chambers filled with a buoyant float 100 of foam material or the like (FIG. 7). FIGS. 12 and 14 show ballast chambers 92 which can be filled with a weighted ballast such as water via resealable fill ports 101, wherein these ballast chambers 92 may protrude vertically to bridge above and below the surface of the water during normal use of the floating skimmer. Conveniently, the use of water ballast permits the skimmer to be packaged and shipped in a lightweight configuration, without ballast, whereupon the customer can fill the ballast chambers 92 quickly and easily prior to the first use of the device. FIG. 13 also depicts flotation chambers 92 which can be filled with buoyant foam 100, or otherwise remain in the form of sealed hollow chambers. Portions of the structures defining the ballast and flotation chambers are circumferentially spaced apart at diametrically opposed positions on the ring-shaped float/ballast assembly 32 to define a pair of generally horizontally oriented surfaces forming the weirs 40.

Figure 9:
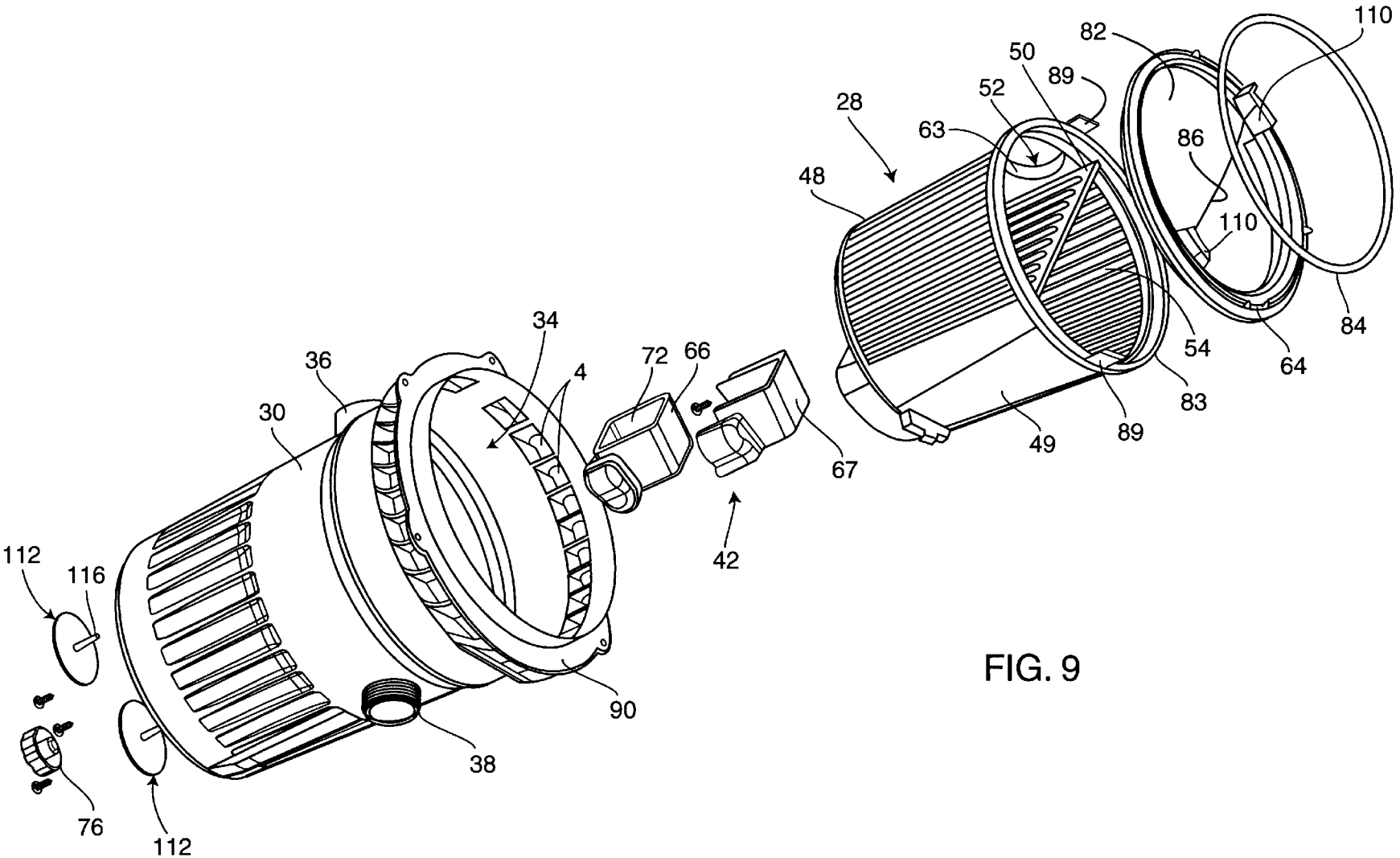
FIG. 9 is an exploded top perspective view illustrating assembly of the components shown in FIG. 8.

The combined flotation and ballast characteristics imparted to the skimmer device by the float/ballast assembly 32 positions the weirs 40 normally at or slightly below the surface 25 of the pool water, as illustrated by the dotted line in FIG. 12. With this arrangement, when the flow control valve assembly 42 is open to permit water flow downwardly to the collection basket 28, water is drawn over the weirs 40 into the upper weir chamber 88 of the skimmer housing 30. This water flow passes over the weirs 40 with a waterfall action to induce floating debris to pass over the weirs into the skimmer. Such water and debris passing into the skimmer housing flows through the inlet opening 86 in the basket lid 82 to pass downwardly into the secondary collection chamber 54 where the debris is captured and collected. The water flow is allowed to pass further through the raised and perforated floor segment 56 at the bottom of the secondary collection chamber 54, past the open valve flap 70 of the flow control valve assembly 42, and further upwardly through the opposite raised floor segment 56 of the basket into the interior of the primary collection chamber 52. From this point, the surface-drawn water flow is commingled with the suction flow drawn through the primary debris collection chamber 52. Alternately, it will be recognized and understood that the raised floor segment 56 of the basket 28 comprises a perforated wall segment interposed between the secondary collection chamber 54 and the water outlet port 38 on the housing 30, whereby the water flow from the secondary collection chamber 54 could be allowed to pass directly to the outlet port 38 without prior passage through the primary collection chamber 52. To insure this water flow passage through the secondary collection chamber 54 despite accumulation of debris therein over a period of time, the interior surface of the imperforate basket side wall 49 as well as the associated surface of the inner divider wall 50 may include vertically extending channels 103 (FIGS. 9–11).

In accordance with one aspect of the invention, the flow control valve assembly 42 is adjustably set to insure proper cleaning operation of the suction-powered pool cleaner 12. That is, the suction-powered pool cleaner normally requires a minimum vacuum level for proper operation of the debris pick-up and transport functions of the pool cleaner. The spring 74 associated with the flow control valve flap 70 is desirably set to be drawn by vacuum within the primary collection chamber 52 only when the vacuum or suction pressure level therein exceeds a minimum threshold sufficient to provide proper pool cleaner operation. In the event that the pump 18 has sufficient capacity to generate the threshold vacuum level while additionally drawing surface-skim flow over the weirs 40, the spring loaded valve flap 70 is drawn to an open or partially open position to permit water to be drawn downwardly through the secondary collection chamber 54, and thereby also permit the desired surface-skimming action. At all times, the flow control valve assembly 42 proportions the flows to provide a relatively high and substantially constant suction pressure level for proper operation of the pool cleaner 12, while providing a comparatively lower suction pressure for surface skimming action whenever sufficient pump capacity is available. As previously described, the specific suction pressure required to open the valve flap 70 can be adjustably set in a fine-tuned manner to meet the operating requirements of a particular pool cleaner 12 in a specific swimming pool. The adjustment knob 76 is conveniently located at the underside of the skimmer housing 30 for easy access, yet the movable valve flap 70 is safely concealed within the skimmer housing where it is not exposed to accidental access by swimmers which could otherwise undesirably result in suction entrapment of hair, etc.

The water level regulator float 44 comprises a floating valve in the form of an annular ring or sleeve fitted with a buoyant member 102 of foam material or the like, and defining a radially open window 104 for variable alignment with the auxiliary water intake ports 46 formed in the skimmer housing 30. The regulator float 44 is designed to rise and fall within the upper weir chamber 88 to follow the specific water level therein. In this regard, downward flow of water from the upper weir chamber 88 through the valve assembly 42 to the underlying collection basket 28 will normally cause the water level in the upper weir chamber 88 to be below the pool surface 25, thereby inducing the waterfall action over the weirs 40.

As the water level within the upper weir chamber 88 decreases, the regulator float 44 descends for alignment of a progressively increasing area of the window 104 with the auxiliary intake ports 46. As a result, additional water is allowed to be drawn into the weir chamber 88 through the intake ports 46, thereby preventing cavitation of the skimmer housing and potential damage to the pump 18. Conversely, as the water level within the upper weir chamber 88 rises, the regulator float 44 ascends to decrease the area of the window 104 aligned with the intake ports 46 to correspondingly decease the auxiliary intake flow to the skimmer. At an uppermost position (FIG. 14), the float window 104 is completely out of alignment with the intake ports 46 to prevent auxiliary intake water flow therethrough. FIGS. 12–13 show the regulator float in a substantially lowermost position with the intake ports 46 substantially fully exposed for maximum water inflow to the skimmer interior.

Figure 20:
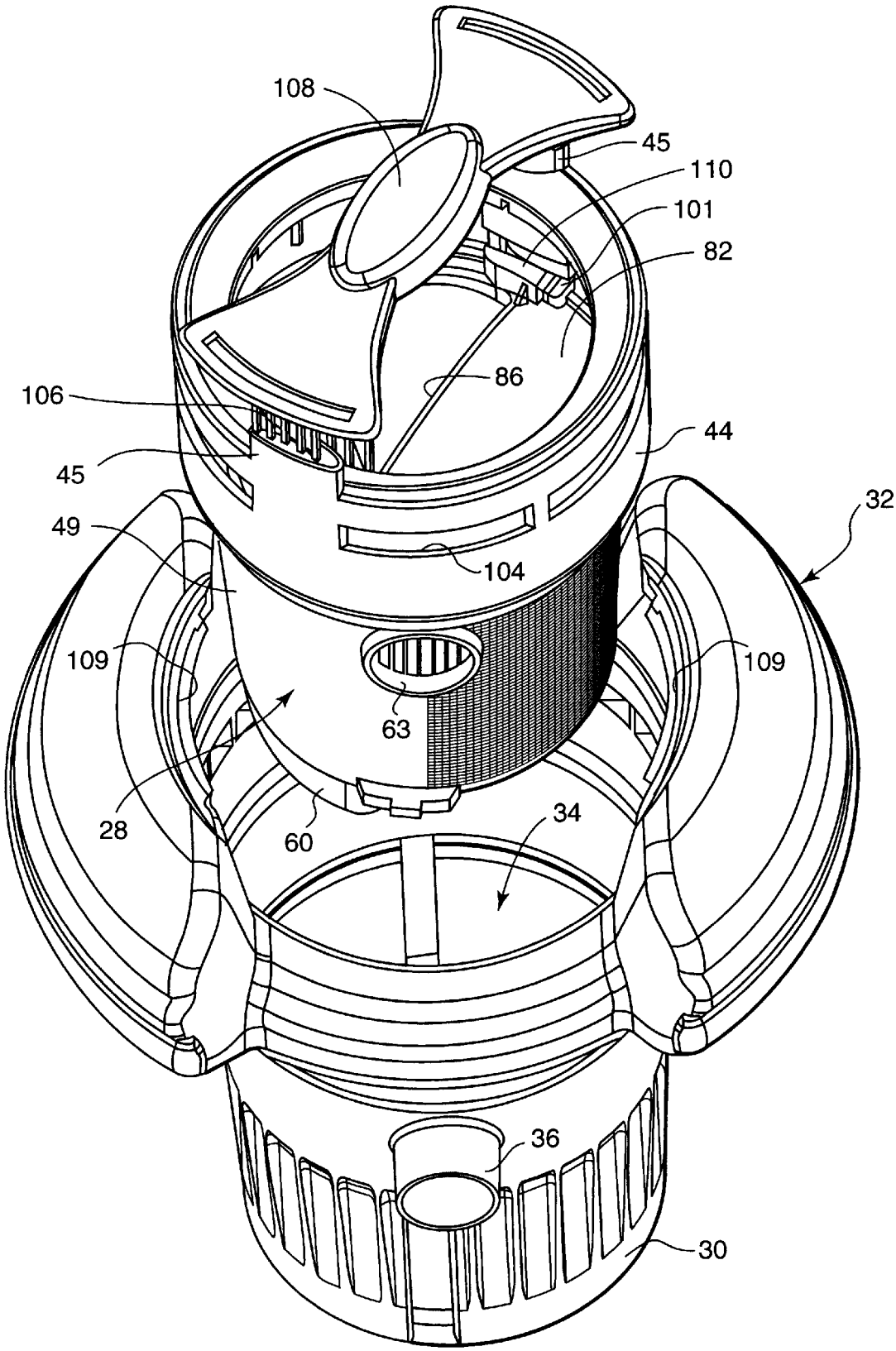
FIG. 20 is an exploded top perspective view showing lift-out separation of the collection basket from the skimmer housing.
Figure 21:
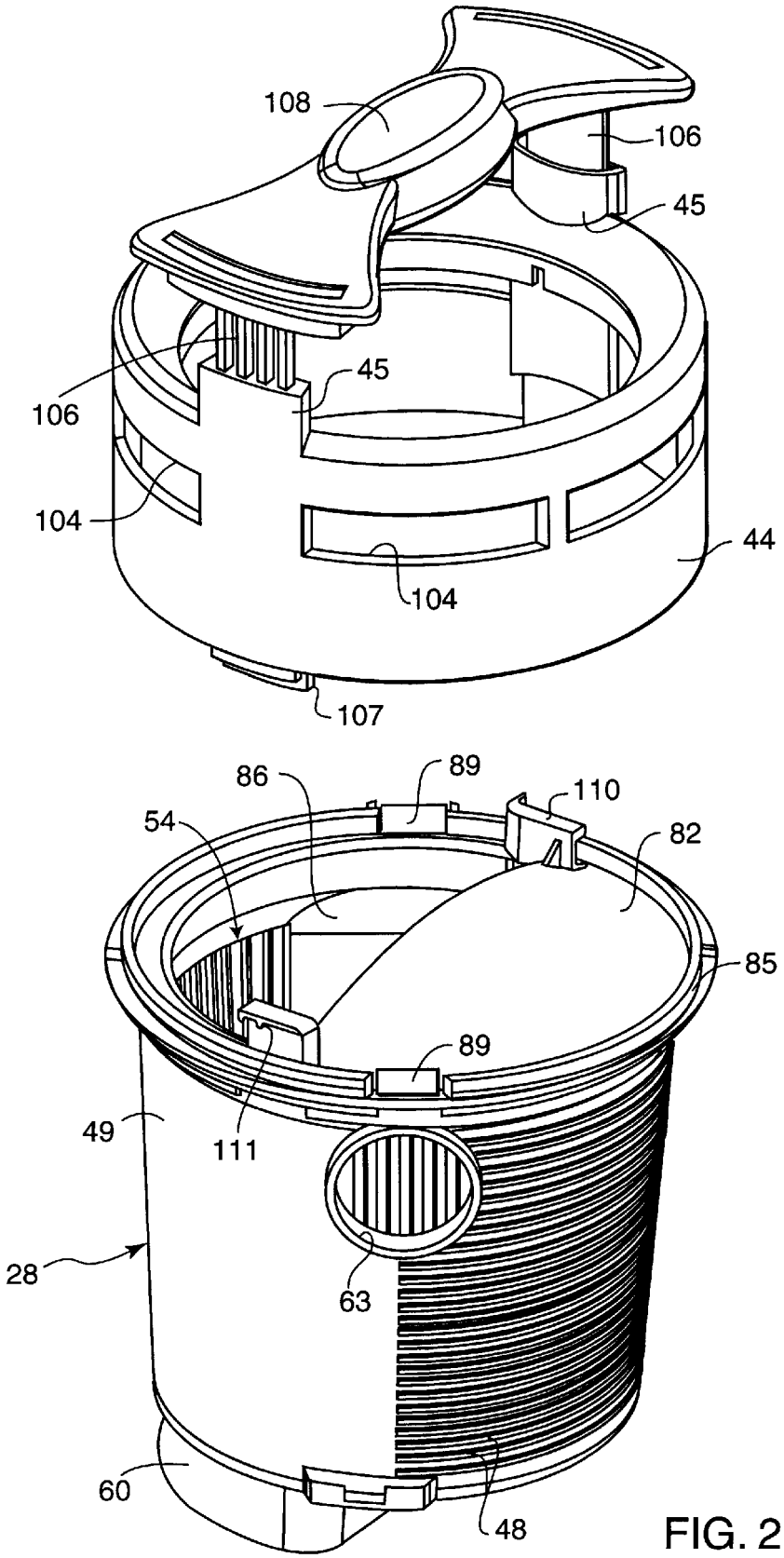
FIG. 21 is an exploded perspective view depicting disassembly of the handle and the water level regulator float from the collection basket.
Figure 22:
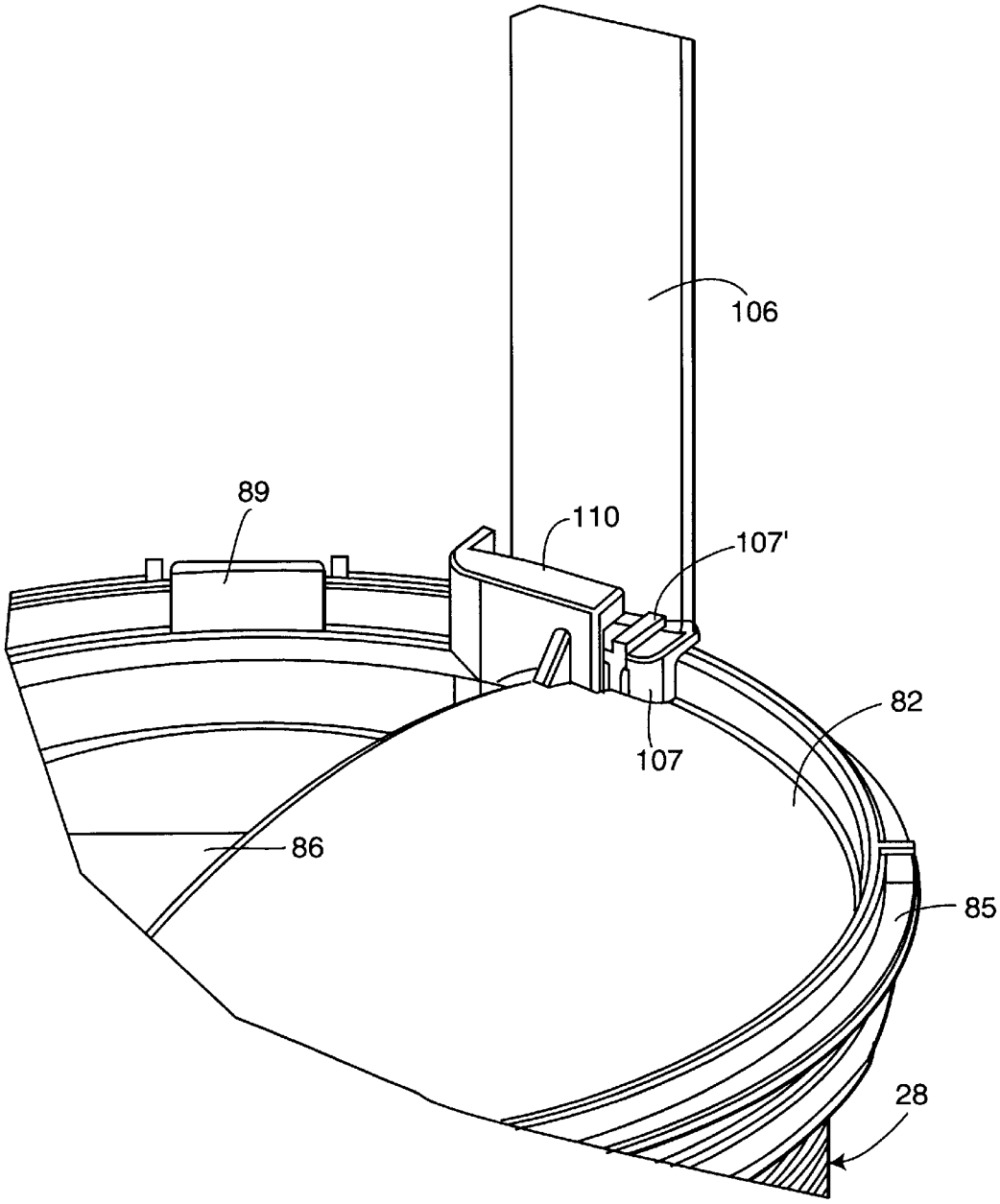
FIG. 22 is an enlarged fragmented perspective view depicting a separable connection between the collection basket and a guide post protruding downwardly from the handle.
Figure 23:
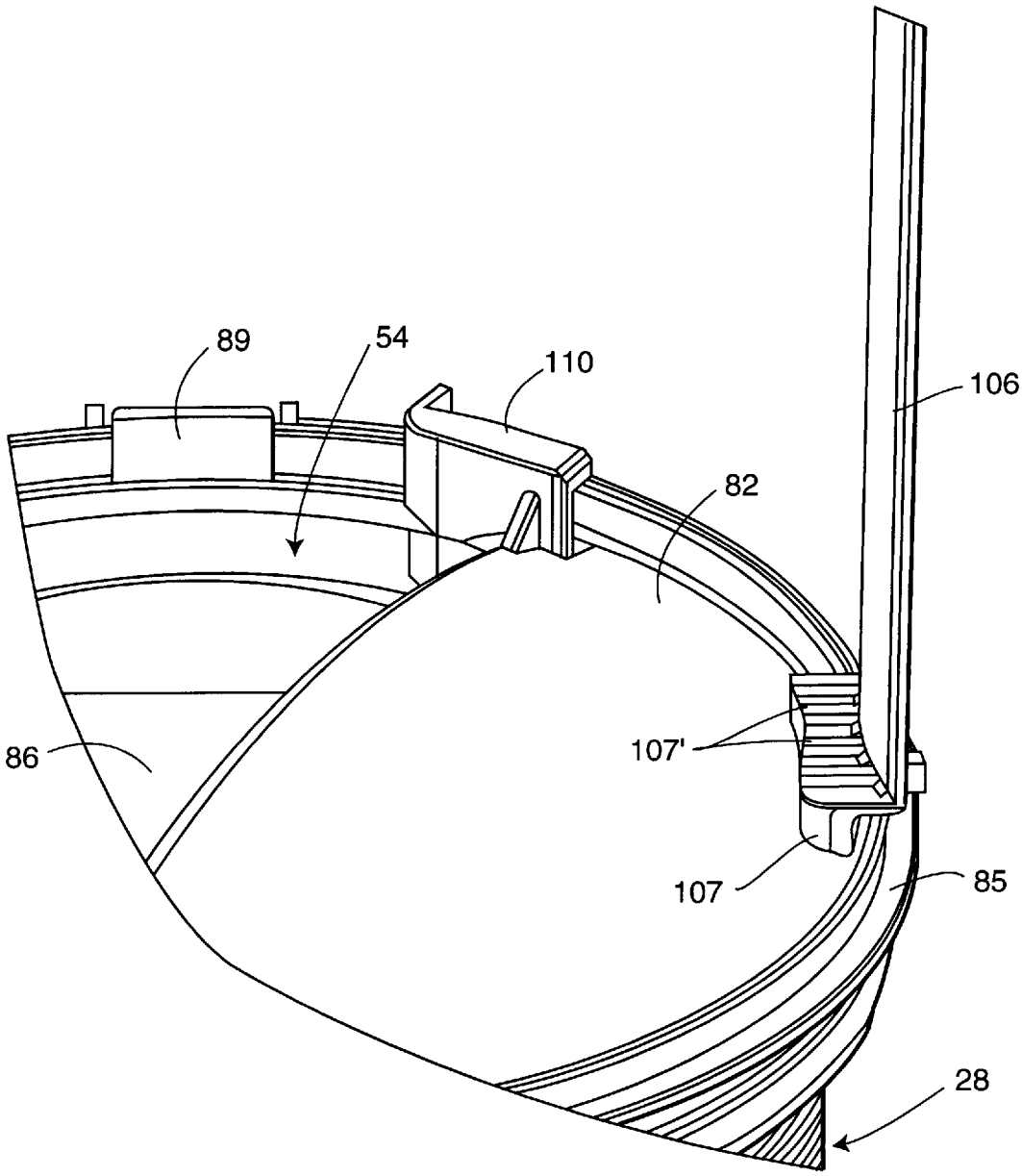
FIG. 23 is an enlarged fragmented perspective view similar to FIG. 22, but illustrating rotatable displacement of the handle guide post to a position released from the collection basket.
Figure 24:
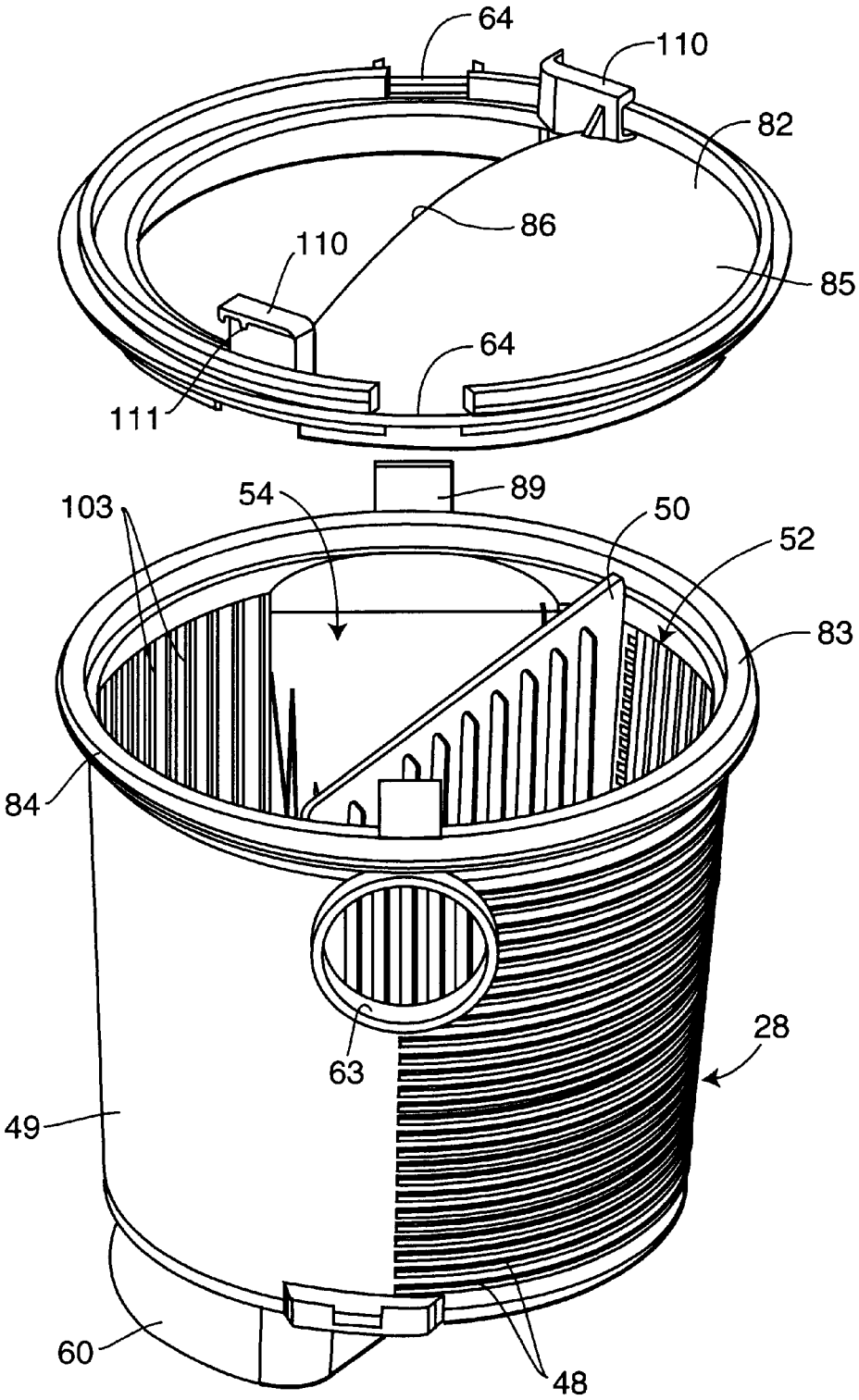
FIG. 24 is an exploded perspective view showing removal of a basket lid from the collection basket to permit disposal of debris and the like collected therein.

The regulator float 44 is carried slidably by means of sleeve segments 45 thereon (FIG. 13) mounted about a pair of vertically oriented guide posts 106 (FIGS. 7 and 13) which depend from a handle 108 mounted removably by a snap-fit or twist-lock connection with a channeled track 109 (FIG. 19) on the float/ballast assembly 32. The lower ends of these guide posts 106 include radially inwardly turned feet 107 (FIGS. 7 and 22–23) shaped for lateral rotation into an associated pair of keepers 110 formed on the rim 85 of the basket lid 82. With this construction, the handle 108 can be rotated through a part-circle increment as viewed in FIG. 19 for release from the float/ballast assembly 32, whereupon the handle 108 can be lifted upwardly to lift the underlying regulator float 44 and the collection basket 28 from the skimmer housing (as shown in FIG. 20). Upon such handle rotation, detent ribs 107' on the guide post feet 107 engage an associated detent rib 111 (FIG. 21) on the keeper 110 to maintain engagement with the keeper. After the handle 108 and the collection basket 28 suspended therefrom is lifted from the skimmer housing 30, the handle 108 with associated guide posts 106 can be rotated relative to the underlying collection basket 28, as viewed in FIGS. 22–23, to release the guide post feet 107 from the basket lid 82, and the collection basket 28 can then be separated from the handle 108. Following this, the basket lid 82 can be unlatched from the top of the collection basket 28 to open both of the collection chambers and thereby permit discarding of the collected debris from both the primary and secondary debris collection chamber 52, 54. Thereafter, the components can be re-assembled quickly and easily in a reverse order, followed by return slide-fit drop-in installation of the collection basket 28 into the interior 34 of the skimmer housing 30 with appropriate rotation of the handle 108 for re-connection to the float/ballast assembly 32.

In use, the floating skimmer 10 is installed along the length of the vacuum hose 16. When the pool filtration equipment 14 is turned off, the skimmer 10 floats passively in the pool water, with the flow control valve assembly 42 in a normally closed position to separate the primary and secondary debris collection chambers 52, 54 from each other. In this nonoperating condition, the water level within the upper weir chamber 88 in the skimmer housing 30 rises substantially to the surface level of the pool water, and the regulator float 44 rises correspondingly to a maximum level substantially closing the auxiliary intake ports 46.

When the pump 18 is turned on, water is drawn under vacuum through the vacuum hose 16 from the pool cleaner 12 to initiate cleaner operation. Specifically, water under suction pressure is drawn along the vacuum hose 16 in a manner to draw water through the skimmer housing 30 from the inlet port 36 to the outlet port 38. This water flow causes water and entrained debris to be drawn from the pool cleaner 12 into the interior of the primary debris collection chamber 52. The debris is captured and retained within the primary collection chamber 52 while the water flow continues through the outlet port 38 to the filtration equipment 14.

As soon as the vacuum level along the hose 16, and thus also within the primary collection chamber 52 rises to a threshold level sufficient to open the flow control valve assembly 42, water is drawn simultaneously from the pool cleaner 12 and also into the secondary collection chamber 54 by passage over the weirs 40 at the surface of the swimming pool. The water and floating debris passes over the weirs into the upper weir chamber 88, and further downwardly through the inlet opening 86 in the housing lid 82 into the secondary collection chamber 54 where the debris is captured and retained. The water flow passes further through the raised floor segment 56 of the basket 28, and past the open valve flap 70 to the primary collection chamber 52. Accordingly, when sufficient pump capacity is present, dual water flows enter the collection basket 28 so that debris picked up by the pool cleaner 12 as well as debris skimmed over the weirs 40 from the water surface is captured in the basket. When surface-skimming flow is provided, the regulator float 44 rises and falls as appropriate within the upper weir chamber 88 to regulate the water level therein between upper and lower predetermined limit, by modulating supplemental or auxiliary water inflow through the circumferential intake ports 46.

The float/ballast assembly 32 functions during normal operation to maintain the weirs 40 at a desired position slightly below the surface of the pool water. More particularly, as the water level within the upper weir chamber 88 falls during operation as described above, the weight of the skimmer 10 is reduced whereby the skimmer will tend to rise in the body of pool water. By forming the ballast and float chambers 92 to bridge the pool water surface, vertically upward movement of the skimmer in the water serves to move an increasing portion of the ballast to a location above the water surface. Such upward movement of the ballast effectively resists any significant upward skimmer displacement sufficient to move the weirs 40 to a position above the pool water line.

A pair of drain valves 112 (FIGS. 6–9, and 16–18) are provided in the bottom wall 68 of the lower housing 30, to permit water within the housing 30 to drain from the primary and secondary debris collection chambers 52, 54, when the skimmer 10 is removed from the pool water. These drain valves 112 are positioned on opposite sides of the flow control valve assembly 42, in respective association with the pair of debris collection chambers 52, 54, when the skimmer 10 is fully assembled for operation. Each drain valve 110 comprises a resilient valve flap 114 carried on a mounting stem 116 at the underside of associated drain ports 118 formed in the housing bottom wall 68. During normal operation with suction pressure within the skimmer housing 30, the valve flaps 114 are drawn to a closed position to prevent water outflow or drainage from the housing interior through the drain ports 118 (shown best in FIG. 17). However, when the system is turned off to relieve the suction pressure within the skimmer housing, the valve flaps 114 are free to fall to the dotted line open positions depicted in FIG. 18. In the open positions, particularly when the skimmer 10 is lifted from the pool water for discarding of collected debris, water within the skimmer housing 30 is free to drain through the drain ports 118 to the exterior of the skimmer housing. Thus, water within the skimmer 10 can be drained quickly and easily, if desired, by simply lifting the unit from the pool water and holding the unit over the pool water while the water within the housing 30 drains through the pair of drain valves 112.

A variety of modifications and improvements in and to the floating skimmer of the present invention will be apparent to those persons skilled in the art. For example, it will be recognized and understood that the flow control valve assembly 42 may take other forms, such as a resilient diaphragm valve of the type disclosed in U.S. Pat. No. 5,634,229, which is incorporated by reference herein. Moreover, it will be appreciated that separate collection baskets defining the primary and secondary debris collection chambers 52, 54 may be provided, if desired. Accordingly, no limitation on the invention is intended by way of the foregoing description and accompanying drawings, except as set forth in the appended claims.

What is claimed is:

1. A floating skimmer, comprising:

a buoyant housing defining a hollow interior, and further defining a water inlet port and a water outlet port for in-line connection with a vacuum hose coupled between a suction-powered pool cleaner and a suction side of a pool water filtration system, said inlet and outlet ports being in flow communication with said hollow interior, whereby water drawn by the filtration system from the pool cleaner flows through said housing;

debris collection means within said hollow interior of said buoyant housing and defining a primary debris collection chamber and a secondary debris collection chamber, said collection means further defining an inlet for water flow through said water inlet port into said primary collection chamber for capture of water-entrained debris therein, and a perforated side wall disposed in flow communication with said water outlet port to permit water flow from said primary collection chamber and through said perforated side wall to said outlet port;

said housing further defining an upper weir chamber disposed generally above said collection means, and at least one weir for spillover flow of water from a pool surface into said upper weir chamber;

said secondary collection chamber being disposed in flow communication between said upper weir chamber and said outlet port, whereby water flow from a pool surface into said upper weir chamber carries floating debris through said upper weir chamber into said secondary collection chamber for capture therein, said collection means further defining at least one perforated wall segment separating said secondary collection chamber from said outlet port to permit water flow from said secondary collection chamber to said outlet port;

a flow control valve assembly including a valve member movable between a closed position and an open position for regulating water flow from said upper weir chamber into said secondary collection chamber;

said housing further defining at least one auxiliary intake port opening into said upper weir chamber; and a water level regulator floatably mounted within said upper weir chamber and including means for variably opening and closing said at least one auxiliary intake port for maintaining the water level within said upper weir chamber generally between predetermined maximum and minimum level limits.

2. The floating skimmer of claim 1 wherein said housing comprises a generally upwardly open lower container housing having a float assembly mounted at an upper end thereof, said float assembly defining at least one flotation chamber.

3. The floating skimmer of claim 2 wherein said float assembly further defines at least one ballast chamber for containing a selected ballast, said ballast chamber extending at least partially above the surface of the pool water.

4. The floating skimmer of claim 2 wherein said at least one weir is formed by said float assembly.

5. The floating skimmer of claim 2 wherein said at least one weir comprises a pair of weirs defined by said float assembly.

6. The floating skimmer of claim 1 wherein said at least one weir comprises a pair of weirs at generally diametrically opposed positions on said housing.

7. The floating skimmer of claim 1 wherein said perforated side wall forming said primary collection chamber is disposed in at least slightly spaced relation with said water outlet port.

8. The floating skimmer of claim 1 wherein said debris collection means comprises an upwardly open perforated basket having an internal imperforate divider wall subdividing the interior of said basket into said primary and secondary debris collection chambers, and further including a lid mounted on an upper end of said basket to substantially prevent flow communication between said primary collection chamber and said upper weir chamber, said lid permitting flow communication between said secondary collection chamber and said upper weir chamber.

9. The floating skimmer of claim 8 wherein said basket is removably mounted within said buoyant housing.

10. The floating skimmer of claim 8 wherein said at least one perforated wall segment separating said secondary collection chamber from said outlet port is interposed between said secondary collection chamber and said primary collection chamber to permit water flow from said secondary collection chamber to said primary collection chamber and further therefrom to said outlet port.

11. The floating skimmer of claim 10 wherein said at least one perforated wall segment comprises a pair of perforated wall segments interposed between said secondary and primary collection chambers and further defining a transition chamber disposed between said secondary and primary collection chambers, said valve member of said flow control valve assembly being disposed within said transition chamber.

12. The floating skimmer of claim 11 wherein said transition chamber is disposed generally at the bottom of said interior of said buoyant housing.

13. The floating skimmer of claim 11 wherein said flow control valve assembly includes spring means for biasing said valve member normally to said closed position, said valve member being movably responsive to water pressure within said primary collection chamber for movement to said open position.

14. The floating skimmer of claim 13 further including adjustment means accessible from the exterior of said buoyant housing for adjustably setting the spring force applied by said spring means to said valve member.

15. The floating skimmer of claim 1 wherein said flow control valve assembly includes spring means for biasing said valve member normally to said closed position, said valve member being movably responsive to water pressure within said primary collection chamber for movement to a modulated open position for maintaining the suction pressure within said primary collection chamber at a substantially constant pressure level.

16. The floating skimmer of claim 1 wherein said water level regulator comprises a buoyant sleeve within said upper weir chamber and defining a generally annular surface for variable alignment with said at least one auxiliary intake port.

17. The floating skimmer of claim 1 wherein said at least one auxiliary intake port comprises a plurality of auxiliary intake ports disposed in a pattern about the periphery of said housing.

18. The floating skimmer of claim 1 further including drain valve means for draining water from said primary and secondary collection chambers, said drain valve means being responsive to suction pressure within said housing for movement to a closed position.

19. The floating skimmer of claim 1 further including a handle removably mounted on said housing, said handle including means for supporting said water level regulator for floating movement within said upper weir chamber, said handle and said water level regulator being removable from said housing as a unit.

20. The floating skimmer of claim 19 wherein said handle is removably connected to said collection basket, said handle and said water level regulator and said collection basket being removable from said housing as a unit.

21. A floating skimmer, comprising:

a buoyant housing defining a hollow interior, and further defining a water inlet port and a water outlet port for in-line connection with a vacuum hose coupled between a suction-powered pool cleaner and a suction side of a pool water filtration system, said inlet and outlet ports being in flow communication with said hollow interior, whereby water drawn by the filtration system from the pool cleaner flows through said housing;

debris collection means within said hollow interior of said buoyant housing and defining at least one debris collection chamber, said collection means further defining an inlet for water flow through said water inlet port into said at least one collection chamber for capture of water-entrained debris therein, and a perforated side wall disposed in flow communication with said water outlet port to permit water flow from said at least one collection chamber and through said perforated side wall to said outlet port;

said housing further defining an upper weir chamber disposed generally above said collection means, and at least one weir for spillover flow of water from a pool surface into said upper weir chamber;

means defining a flow path for flow of water from said upper weir chamber downwardly into said at least one collection chamber;

said housing further defining at least one auxiliary intake port opening into said upper weir chamber; and a water level regulator floatably mounted within said upper weir chamber and including means for variably opening and closing said at least one auxiliary intake port for maintaining the water level within said upper weir chamber generally between predetermined maximum and minimum level limits.

22. The floating skimmer of claim 21 further comprising a flow control valve assembly having a valve member movably responsive to water pressure within said at least one collection chamber for regulating water flow downwardly from said weir chamber.

23. The floating skimmer of claim 21 wherein said housing comprises a generally upwardly open lower container housing having a float assembly mounted at an upper end thereof, said float assembly defining at least one flotation chamber.

24. The floating skimmer of claim 23 wherein said float assembly further defines at least one ballast chamber for containing a selected ballast, said ballast chamber extending at least partially above the surface of the pool water.

25. The floating skimmer of claim 21 wherein said at least one weir comprises a pair of weirs at generally diametrically opposed positions on said housing.

26. The floating skimmer of claim 21 wherein said perforated side wall of said collection means is disposed in at least slightly spaced relation with said water outlet port.

27. The floating skimmer of claim 21 wherein said collection means comprises a collection basket removably mounted within said buoyant housing.

28. The floating skimmer of claim 21 wherein said water level regulator comprises a buoyant sleeve within said upper weir chamber and defining a generally annular surface for variable alignment with said at least one auxiliary intake port.

29. The floating skimmer of claim 21 wherein said at least one auxiliary intake port comprises a plurality of auxiliary intake ports disposed in a pattern about the periphery of said housing.

30. The floating skimmer of claim 21 further including a handle removably mounted on said housing, said handle including means for supporting said water level regulator for floating movement within said upper weir chamber, said handle and said water level regulator being removable from said housing as a unit.

31. The floating skimmer of claim 30 wherein said handle is removably connected to said collection means, said handle and said water level regulator and said collection means being removable from said housing as a unit.

32. A floating skimmer, comprising:

a buoyant housing defining a hollow interior, and further defining a water inlet port and a water outlet port for in-line connection with a vacuum hose coupled between a suction-powered pool cleaner and a suction side of a pool water filtration system, said inlet and outlet ports being in flow communication with said hollow interior, whereby water drawn by the filtration system from the pool cleaner flows through said housing;

a debris collection basket removably mounted within said hollow interior of said buoyant housing, said basket having an upwardly open geometry and further including an internal imperforate divider wall subdividing the basket interior into a primary debris collection chamber and a secondary debris collection chamber;

said collection basket further defining an inlet for water flow through said water inlet port into said primary collection chamber for capture of water-entrained debris therein, and a perforated side wall disposed in flow communication with said water outlet port to permit water flow from said primary collection chamber and through said perforated side wall to said outlet port;

said housing further defining an upper weir chamber disposed generally above said collection basket, and at least one weir for spillover flow of water from a pool surface into said upper weir chamber;

said secondary collection chamber being disposed in flow communication between said upper weir chamber and said outlet port, whereby water flow from a pool surface into said upper weir chamber carries floating debris through said upper weir chamber into said secondary collection chamber for capture therein, said collection basket further defining at least one perforated wall segment separating said secondary collection chamber from said outlet port to permit water flow from said secondary collection chamber to said outlet port; and a flow control valve assembly including a valve member movable between a closed position and an open position in response to the section pressure level within said primary collection chamber for regulating water flow from said upper weir chamber into said secondary collection chamber, said valve member being disposed in flow communication between said secondary collection chamber and said outlet port.

33. The floating skimmer of claim 32 wherein said housing further defines at least one auxiliary intake port opening into said upper weir chamber, and further comprising a water level regulator floatably mounted within said upper weir chamber and including means for variably opening and closing said at least one auxiliary intake port for maintaining the water level within said upper weir chamber generally between predetermined maximum and minimum level limits.

34. The floating skimmer of claim 32 wherein said housing comprises a generally upwardly open lower container housing having a float assembly mounted at an upper end thereof, said float assembly defining at least one flotation chamber.

35. The floating skimmer of claim 34 wherein said float assembly further defines at least one ballast chamber for containing a selected ballast, said ballast chamber extending at least partially above the surface of the pool water.

36. The floating skimmer of claim 34 wherein said at least one weir is formed by said float assembly.

37. The floating skimmer of claim 34 wherein said at least one weir comprises a pair of weirs defined by said float assembly.

38. The floating skimmer of claim 32 wherein said at least one weir comprises a pair of weirs at generally diametrically opposed positions on said housing.

39. The floating skimmer of claim 32 wherein said at least one perforated side wall forming said primary collection chamber is disposed in at least slightly spaced relation with said water outlet port.

40. The floating skimmer of claim 32 further including a lid mounted on an upper end of said basket to substantially prevent flow communication between said primary collection chamber and said upper weir chamber, and said lid having an inlet opening formed therein to permit flow communication between said secondary collection chamber and said upper weir chamber.

41. The floating skimmer of claim 40 wherein said at least one perforated wall segment separating said secondary collection chamber from said outlet port is interposed between said secondary collection chamber and said primary collection chamber to permit water flow from said secondary collection chamber to said primary collection chamber and further therefrom to said outlet port.

42. The floating skimmer of claim 41 wherein said at least one perforated wall segment comprises a pair of perforated wall segments interposed between said secondary and primary collection chambers and further defining a transition chamber disposed between said secondary and primary collection chambers, said valve member of said flow control valve assembly being disposed within said transition chamber.

43. The floating skimmer of claim 42 wherein said transition chamber is disposed generally at the bottom of said interior of said buoyant housing.

44. The floating skimmer of claim 42 wherein said flow control valve assembly includes spring means for biasing said valve member normally to said closed position, said valve member being movably responsive to water pressure within said primary collection chamber for movement to said open position.

45. The floating skimmer of claim 44 further including adjustment means accessible from the exterior of said buoyant housing for adjustably setting the spring force applied by said spring means to said valve member.

46. The floating skimmer of claim 32 further including a handle removably mounted on said housing, said handle including means for supporting said water level regulator for floating movement within said upper weir chamber, said handle and said water level regulator being removable from said housing as a unit.

47. The floating skimmer of claim 46 wherein said handle is removably connected to said collection basket, said handle and said water level regulator and said collection basket being removable from said housing as a unit.

* * * * *